US008827403B2

(12) United States Patent
Miyamoto et al.

(10) Patent No.: US 8,827,403 B2
(45) Date of Patent: Sep. 9, 2014

(54) PRINTING APPARATUS AND PRINTING METHOD

(71) Applicant: Seiko Epson Corporation, Tokyo (JP)

(72) Inventors: Toru Miyamoto, Shiojiri (JP); Kimitaka Kamijo, Shiojiri (JP); Mitsuhisa Ando, Matsumoto (JP); Toru Takahashi, Azumino (JP); Takamitsu Kondo, Shiojiri (JP); Kazuyoshi Tanase, Matsumoto (JP); Hiroshi Wada, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 153 days.

(21) Appl. No.: 13/655,929

(22) Filed: Oct. 19, 2012

(65) Prior Publication Data

US 2013/0100191 A1 Apr. 25, 2013

(30) Foreign Application Priority Data

Oct. 20, 2011 (JP) ..... 2011-230993
Oct. 20, 2011 (JP) ..... 2011-230994

(51) Int. Cl.
*B41J 29/38* (2006.01)
*B41J 2/21* (2006.01)
*B41J 11/00* (2006.01)

(52) U.S. Cl.
CPC ..... *B41J 2/2114* (2013.01); *B41J 2/2128* (2013.01); *B41J 11/002* (2013.01)
USPC ..... 347/14; 347/15; 347/43

(58) Field of Classification Search
CPC ..... B41J 2/212; B41J 3/543; B41J 2002/022; B41J 29/393; B41J 2/04575
USPC ..... 347/9, 12, 14, 15, 19, 20, 40–43, 54
See application file for complete search history.

(56) References Cited

U.S. PATENT DOCUMENTS

2006/0214966 A1* 9/2006 Tatsumi ..... 347/15
2008/0136854 A1* 6/2008 Yamaguchi et al. ..... 347/12

FOREIGN PATENT DOCUMENTS

JP 2000-158793 6/2000

* cited by examiner

*Primary Examiner* — Thinh Nguyen
(74) *Attorney, Agent, or Firm* — Workman Nydegger

(57) ABSTRACT

A head unit is provided that includes a plurality of head groups having a first head and a second head in a direction which crosses a transport direction of a medium. Color difference is obtained which indicates difference in color between patches formed for each band using dots having the same dot diameter from among a plurality of patches based on the result of color measurement performed on a test pattern which includes the plurality of patches for each band, the plurality of patches being formed for each head group using dots having different dot diameters. The amount of first ink and the amount of second ink, which are respectively ejected from the first head and the second head which are included in all the head groups, are adjusted such that the dot diameter becomes the dot diameter which is determined based on the color difference.

13 Claims, 18 Drawing Sheets

| DOT DIAMETER | a | b | c | d |
|---|---|---|---|---|
| ΔE | 1.21 | 0.35 | 0.20 | 0.53 |
| σ | ○ | ○ | × | ○ |

DOT DIAMETER = b IS SELECTED
(σ IS ○, AND ΔE IS MINIMUM)

| DOT DIAMETER | a | b | c | d |
|---|---|---|---|---|
| ΔG | 1.21 | 0.35 | 0.20 | 0.53 |
| σ | ○ | ○ | × | ○ |

DOT DIAMETER = b IS SELECTED
(σ IS ○, AND ΔG IS MINIMUM)

PRINTING APPARATUS AND PRINTING METHOD

BACKGROUND

1. Technical Field

The present invention relates to a printing apparatus and a printing method.

2. Related Art

A printing apparatus has been known which prints an image by ejecting liquid such as ink or the like from a head unit and landing droplets (dots) on a medium. As the printing apparatus, there is a printing apparatus which ejects photo-curable ink (for example, ultraviolet (UV) ink) which is cured when ink is irradiated with light, for example, UV rays, visible rays, or the like. In such a printing apparatus, after the UV ink is ejected onto the medium from nozzles, light is radiated to UV ink dots which are formed on the medium. Therefore, the UV ink dots are cured and are fixed on the medium (for example, refer to JP-A-2000-158793).

A method disclosed in JP-A-2000-158793 suppresses the generation of bleeding which occurs between UV ink dots by curing the UV ink dots which are ejected onto a medium using light, thereby easily forming an image with excellent image quality. However, even in this method, there are problems related to the color difference and/or the glossiness difference of the image. For example, in a so-called line head type printing apparatus which ejects ink from a plurality of head units which are in a row in the width direction of the medium, there is a case in which positions in which ink dots are landed on the medium are deviated due to the deviation of the arrangement of each head unit or the influence of meandering which occurs when the medium is transported. In this case, color difference and/or glossiness difference occurs by location in a printed image, thereby deteriorating image quality. In addition, such a problem is not limited to the case in which printing is performed using UV ink, and may occur in printing using normal ink (for example, general water-based ink or the like which is fixed to the medium by permeating therethrough).

SUMMARY

An advantage of some aspects of the invention is to improve the image quality of a printed image in a line head type printing apparatus.

According to an aspect of the invention, there is provided a printing apparatus including a head unit that includes a plurality of head groups in a direction which crosses a transport direction, each of the head groups having a first head which ejects first ink to a medium transported in the transport direction, and a second head which is arranged in the transport direction together with the first head and which ejects second ink onto the medium. An image is printed by forming dots using the first ink and dots using the second ink in bands, which are regions to which the ink is ejected, for each head group. Color difference, which indicates difference in color between patches formed for each band using dots each having same dot diameter from among a plurality of patches, is obtained based on a result of color measurement performed on a test pattern which includes the plurality of patches for each band, each of the plurality of patches being formed for each head group using dots having different dot diameters. An amount of the first ink and an amount of the second ink, which are respectively ejected from the first head and the second head which are included in all the head groups, are adjusted such that the dot diameter is determined based on the color difference.

Other features of the present invention will be apparent in the description of the present specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
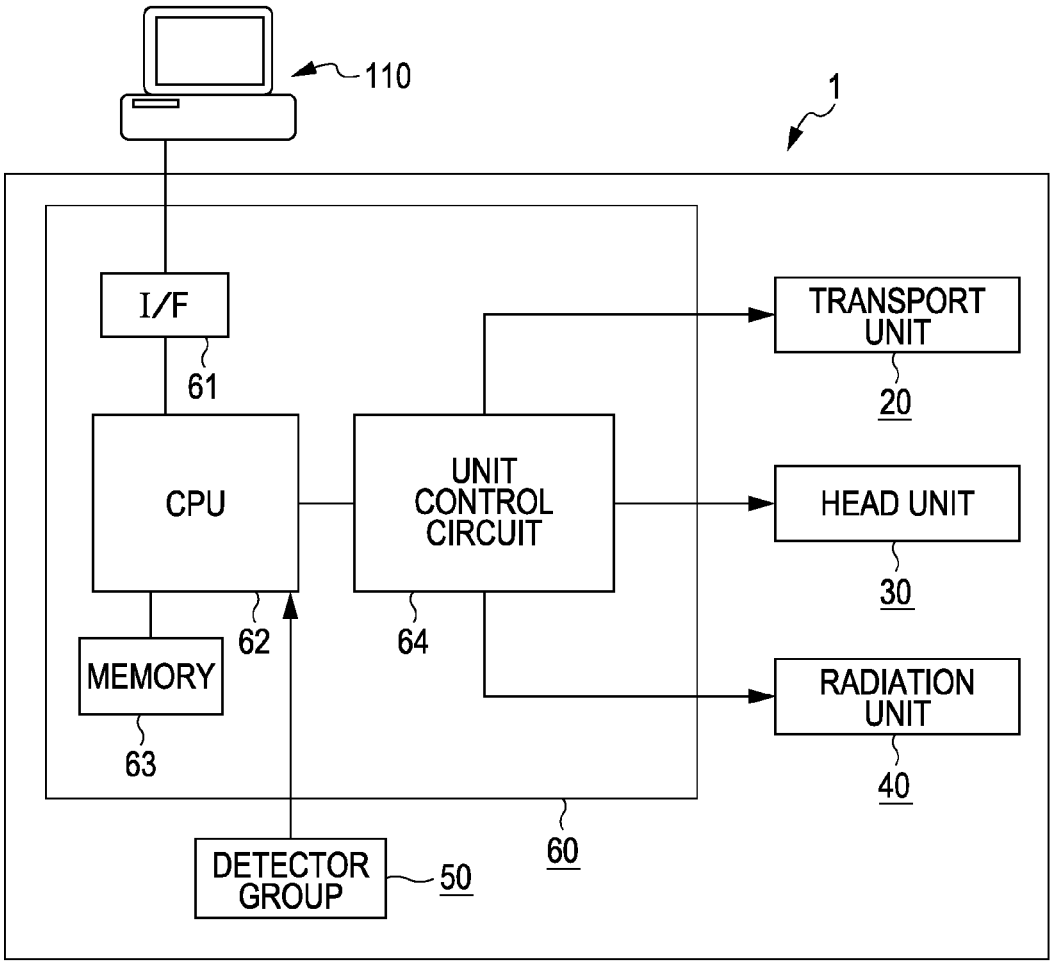
FIG. 1 is a block diagram illustrating the whole configuration of a printer.

At least the following points will be apparent based on the description of the present specification and the accompanying drawings.

A printing apparatus including: a head unit that includes a plurality of head groups in a direction which crosses a transport direction, each of the head groups having a first head which ejects first ink to a medium transported in the transport direction, and a second head which is arranged in the transport direction together with the first head and which ejects second ink onto the medium. An image is printed by forming dots using the first ink and dots using the second ink in bands, which are regions to which the ink is ejected, for each head group. Color difference, which indicates difference in color between patches formed for each band using dots each having same dot diameter from among a plurality of patches, is obtained based on a result of color measurement performed on a test pattern which includes the plurality of patches for each band, each of the plurality of patches being formed for each head group using dots having different dot diameters. An amount of the first ink and an amount of the second ink, which are respectively ejected from the first head and the second head which are included in all the head groups, are adjusted such that the dot diameter is determined based on the color difference.

According to the printing apparatus, it is possible to improve the image quality of an image to be printed in a line head type printing apparatus.

In the printing apparatus, the color difference between the adjacent bands may be calculated based on a value obtained by performing the color measurement on each of the plurality of patches which are formed for each head group using dots having the same dot diameter, the dot diameter may be selected such that the calculated color difference is equal to or less than a defined value or is a minimum value, and the amount of the first ink and the amount of the second ink, which are respectively ejected from the first head and the second head which are included in all the head groups, may be adjusted such that the dot diameter is the selected dot diameter.

According to the printing apparatus, it is possible to print an image, in which the color difference is small and the image quality thereof is excellent, by printing the image in such a way as to select a dot size obtained when the color difference between the bands is equal to or less than the defined value or the color difference is the minimum value.

In the printing apparatus with respect to values respectively obtained by performing the color measurement on the plurality of patches which are formed for each head group using dots having the same dot diameter, the color difference may be calculated based on difference between an average value of the values obtained by performing the color measurement and each of the values obtained by performing the color measurement, the dot diameter may be selected such that the calculated glossiness difference is equal to or less than a defined value, or is a minimum value, and the amount of the first ink and the amount of the second ink, which are respectively ejected from the first head and the second head which are included in all the head groups, may be adjusted such that the dot diameter is the selected dot diameter.

According to the printing apparatus, it is possible to print an image, in which the color difference is small and the image quality thereof is excellent, by printing the image in such a way as to select a dot size obtained when the color difference between the bands is equal to or less than the defined value or the color difference is the minimum value.

In the printing apparatus, based on a result obtained by measuring a density of each of the patches of the test pattern, granularity, which indicates graininess of the patches which are formed for each head group using dots having the same dot diameter from among the plurality of patches, may be obtained, and the amount of the first ink and the amount of the second ink, which are respectively ejected from the first head and the second head which are included in all the head groups, may be adjusted using the dot diameter obtained when the granularity is equal to or less than a specific threshold.

According to the printing apparatus, it is possible to print an image with higher image quality by taking into consideration the graininess in addition to the color difference between the bands.

The printing apparatus may further include a third head that is arranged in the transport direction together with the first head, and that ejects third ink onto the medium. When the first ink is color ink and the third ink is clear ink, an ejecting amount of third ink per unit area is preferably changed based on the ejecting amount of first ink per unit area.

According to the printing apparatus, it is possible to print an image which has desired glossiness by controlling the ejecting amount of clear ink according to the ejecting amount of color ink which is used to print the image. Therefore, it is possible to print a higher-quality image.

The printing apparatus may further include a radiation unit that performs irradiation with light. The ink may be cured when the ink is irradiated with the light.

According to the printing apparatus, it is possible to control the curing of dots by controlling UV irradiation. Therefore, it is possible to form a high-quality image by suppressing the bleeding of image dots. In addition, it is possible to perform printing on a medium which does not include an ink absorbing layer and does not have ink absorbability.

In addition, there is provided a printing method causing a head unit, which includes a plurality of head groups in a direction which crosses a transport direction, each of the head groups having a first head which ejects first ink to a medium transported in the transport direction, and a second head which is arranged in the transport direction together with the first head and which ejects second ink onto the medium, to print an image by forming dots using the first ink and dots using the second ink in bands, which are regions to which the ink is ejected, for each head group. Color difference, which indicates difference in color between patches formed for each band using dots each having same dot diameter from among a plurality of patches, is obtained based on a result of color measurement performed on a test pattern which includes the plurality of patches for each band, each of the plurality of patches being formed for each head group using dots having different dot diameters. An amount of the first ink and an amount of the second ink, which are respectively ejected from the first head and the second head which are included in all the head groups, are adjusted such that the dot diameter is determined based on the color difference.

There is provided a printing apparatus including a head unit that includes a plurality of head groups in a direction which crosses a transport direction, each of the head groups having a first head which ejects first ink to a medium transported in the transport direction, and a second head which is arranged in the transport direction together with the first head and which ejects second ink onto the medium. An image is printed by forming dots using the first ink and dots using the second ink in bands, which are regions to which the ink is ejected, for each head group. Glossiness difference, which indicates difference in glossiness between patches formed for each band using dots each having same dot diameter from among a plurality of patches, is obtained based on a result of glossiness measurement performed on a test pattern which includes the plurality of patches for each band, each of the plurality of patches being formed for each head group using dots having different dot diameters. An amount of the first ink and an amount of the second ink, which are respectively ejected from the first head and the second head which are included in all the head groups, are adjusted such that the dot diameter is determined based on the glossiness difference.

According to the printing apparatus, it is possible to improve the image quality of an image to be printed in a line head type printing apparatus.

In the printing apparatus, the glossiness difference may be calculated based on difference in glossiness between the adjacent bands with respect to the glossiness which is measured from each of the plurality of patches which are formed for each head group using dots having the same dot diameter. The dot diameter may be selected such that the calculated glossiness difference is equal to or less than a defined value or is a minimum value. The amount of the first ink and the amount of the second ink, which are respectively ejected from the first head and the second head which are included in all the head groups, may be adjusted such that the dot diameter is the selected dot diameter.

According to the printing apparatus, it is possible to print an image, in which the color difference is small and the image quality thereof is excellent, by printing the image in such a way as to select a dot size obtained when the color difference between the bands is equal to or less than the defined value or the color difference is the minimum value.

In the printing apparatus, with respect to glossiness measured from each of the plurality of patches which are formed for each head group using dots having the same dot diameter, the glossiness difference may be calculated based on difference between an average value of the glossiness and each glossiness. The dot diameter may be selected such that the calculated glossiness difference is equal to or less than a defined value or is a minimum value. The amount of the first ink and the amount of the second ink, which are respectively ejected from the first head and the second head which are included in all the head groups, may be adjusted such that the dot diameter is the selected dot diameter.

According to the printing apparatus, it is possible to print an image, in which the color difference is small and the image quality thereof is excellent, by printing the image in such a way as to select a dot size obtained when the color difference between the bands is equal to or less than the defined value or the color difference is the minimum value.

In the printing apparatus, based on a result obtained by measuring a density of each of the patches of the test pattern, granularity, which indicates graininess of the patches which are formed for each head group using dots having the same dot diameter from among the plurality of patches, may be obtained. The amount of the first ink and the amount of the second ink, which are respectively ejected from the first head and the second head which are included in all the head groups, may be adjusted using the dot diameter obtained when the granularity is equal to or less than a specific threshold.

According to the printing apparatus, it is possible to print an image with higher image quality by taking into consideration the graininess in addition to the color difference between the bands.

The printing apparatus may further include a third head that is arranged in the transport direction together with the first head, and that ejects third ink onto the medium. When the first ink is color ink and the third ink is clear ink, an ejecting amount of third ink per unit area may be changed based on the ejecting amount of first ink per unit area.

According to the printing apparatus, it is possible to print an image which has desired glossiness by controlling the ejecting amount of clear ink according to the ejecting amount of color ink which are used to print the image. Therefore, it is possible to print a higher-quality image.

The printing apparatus may further include a radiation unit that performs irradiation with light. The ink may be cured when the ink is irradiated with the light.

According to the printing apparatus it is possible to control the curing of dots by controlling UV irradiation. Therefore, it is possible to form a high-quality image by suppressing the bleeding of image dots. In addition, it is possible to perform printing on a medium which does not include an ink absorbing layer and does not have ink absorbability.

Basic Configuration of Printing Apparatus

As the configuration of a printing apparatus which is used in this embodiment, a line printer (printer 1) will be described as an example.

Configuration of Printer 1

A printer 1 is a printing apparatus which records an image by ejecting liquid, such as ink or the like, to a medium, such as paper, cloth, film sheet, or the like. Although the printer 1 is an ink-jet type printer, an apparatus which uses any type of ejecting method may be used as the ink-jet type printer if the apparatus is capable of ejecting ink and performing print.

The printer 1 prints an image on the medium by ejecting ink, which is cured in such a way that the ink, for example, ultraviolet-curable ink (hereinafter, referred to as UV ink) is irradiated with light, such as ultraviolet rays or the like. The UV ink is ink which includes UV curable resin. When ink is irradiated with UV, photo-polymerization reaction occurs in the UV curable resin, thus the UV ink is cured. When printing is performed using the UV ink, it is easy to control the cure degree or the shapes of ink dots which are formed on the medium by controlling the amount of UV irradiation or irradiation timing. Therefore, as described above, it is possible to form an image with excellent image quality by suppressing the generation of bleeding which occurs between UV ink dots. In addition, it is possible to perform printing on a medium, which does not include an ink absorbing layer and does not absorb ink, by curing the UV ink and forming dots.

Meanwhile, the printer 1 according to the embodiment records an image using four types of color ink, that is, black K, cyan C, magenta M, and yellow Y, and transparent and colorless clear ink CL as the UV ink.

FIG. 1 is a block diagram illustrating the whole configuration of a printer 1. The printer 1 includes a transport unit 20, a head unit 30, a radiation unit 40, a detector group 50, and a controller 60. The controller 60 is a control unit which controls each of the units, such as the head unit 30, the radiation unit 40, and the like, based on print data received from a computer 110 which is an external apparatus. The situation within the printer 1 is observed using the detector group 50, and the detector group 50 outputs results of detection to the controller 60. The controller 60 controls each of the units based on the results of detection output from the detector group 50.

Computer 110

The printer 1 is connected to the computer 110 which is the external apparatus such that communication can be performed therebetween. A printer driver is installed in the computer 110. The printer driver is a program which is used to cause a display apparatus to display a user interface, and to convert image data which is output from an application program into print data. The printer driver is recorded in a recording medium (a computer-readable recording medium) such as a Flexible Disk (FD), a Compact Disk Read-Only Memory (CD-ROM), or the like. In addition, the printer driver can be downloaded in the computer 110 via the Internet. Meanwhile, the program is configured with code which is used to implement various types of functions.

The computer 110 outputs print data based on a printed image to the printer 1 in order to cause the printer 1 to print the image. The print data is data having a format which can be analyzed by the printer 1, and includes various types of command data and pixel data. The command data is data which is used to instruct the printer 1 to execute a specific operation. The command data includes, for example, command data which instructs to supply a medium, command data which indicates the amount of transport of a medium, and command data which instructs to discharge a medium. In addition, the pixel data is data which is related to the pixels of a printed image.

Here, the pixels are unit elements which are included in an image, and an image is configured in such a way that the pixels 2-dimensionally line. The pixel data of the print data is data (for example, a grayscale value) which is related to dots formed on a medium (for example, paper S or the like). The pixel data is configured with, for example, 2-bit data for each pixel. The 2-bit pixel data is data which can display a single pixel using 4 grayscales.

Transport Unit 20

Figure 2:
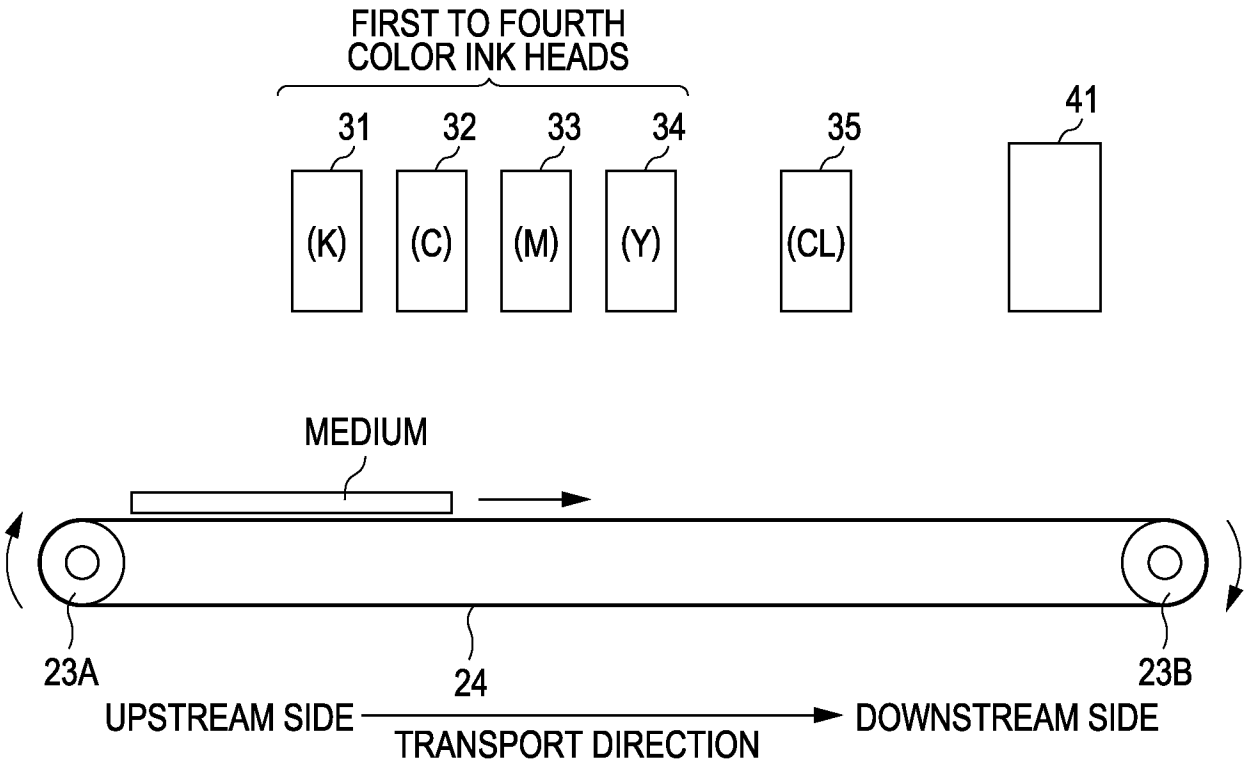
FIG. 2 is a schematic side view illustrating the configuration of the printer.

FIG. 2 shows a schematic side view illustrating the configuration of the printer 1 according to the embodiment.

The transport unit 20 is used to transport the medium in a specific direction (hereinafter, referred to as transport direction). The transport unit 20 includes a transport roller 23A on the upstream side of the transport direction and a transport roller 23B on the downstream side of the transport direction, and a belt 24 (see FIG. 2). If a transport motor which is not shown rotates, the upstream side transport roller 23A and the downstream side transport roller 23B are rotated, thus the belt 24 rotates. A medium which is supplied using the medium supply roller (not shown) is transported to a printable region (a region which face a head unit 30 which will be described later) using the belt 24. The medium which passes through the printable region is discharged to the outside using the belt 24. Meanwhile, the medium which is being transported is electrostatic-adsorbed or vacuum-adsorbed to the belt 24.

Head Unit 30

The head unit 30 is used to eject the UV ink onto the medium. The head unit 30 forms ink dots by ejecting various types of color ink of color KCMY and clear CL onto the medium which is being transported, and prints an image on the medium. The printer 1 according to the embodiment is a line printer, and each head of the head unit 30 can form dots corresponding to the width of the medium at one time.

In the printer 1 shown in FIG. 2, color ink heads 31 to 34 are provided in order from the upstream side of the transport direction. The color ink head includes a first color ink head 31 (hereinafter, referred to as "first head 31"), a second color ink head 32 (hereinafter, referred to as "second head 32"), a third color ink head 33 (hereinafter, referred to as "third head 33"), and a fourth color ink head 34 (hereinafter, referred to as "fourth head 34"). In the embodiment, black ink K is ejected from the first head 31, cyan ink C is ejected from the second head 32, magenta ink M is ejected from the third head 33, and yellow ink Y is ejected from the fourth head 34, respectively. However, arbitrary color is ejected from each of the color ink heads 31 to 34. For example, the first head 31 may eject yellow ink Y, and the second head 32 may eject black ink B. In addition, in addition to the color ink heads 31 to 34, a color ink head which ejects color ink (for example, light cyan, metallic color, or the like) other than the above-described KCMY may be provided. Meanwhile, in first to third embodiments which will be described later, it is assumed that the same color ink is not ejected from different heads. For example, when the first head 31 ejects black ink B, the second to fourth heads 32 to 34 do not eject the black ink B. In addition, in fourth to sixth embodiments which will be described later, the first head 31 and the second head 32 may eject the same color ink. For example, the first head 31 and the second head 32 may eject the cyan ink C. Although it will be described in detail later, the dot diameter of ink dot which is formed on the medium is adjusted in the embodiment, with the result that the difference in glossiness of a printed image to be printed is prevented from being distinguished, thus it is intended to improve image quality. That is, the size of ink dot to be formed is more important than ink color to be ejected.

On the downstream side of the transport direction of the color ink head 34, a clear ink head 35 which ejects transparent and colorless clear CL UV ink is provided. Here, the clear CL ink is ink which does not include a color material or includes little color material and which is generally called "clear ink". Hereinafter, the clear ink head 35 is referred to as a fifth head 35.

Each of the heads includes a plurality of short length heads. Each of the short length heads includes a plurality of nozzles which are eject nozzles used to eject the UV ink.

Figure 3A:
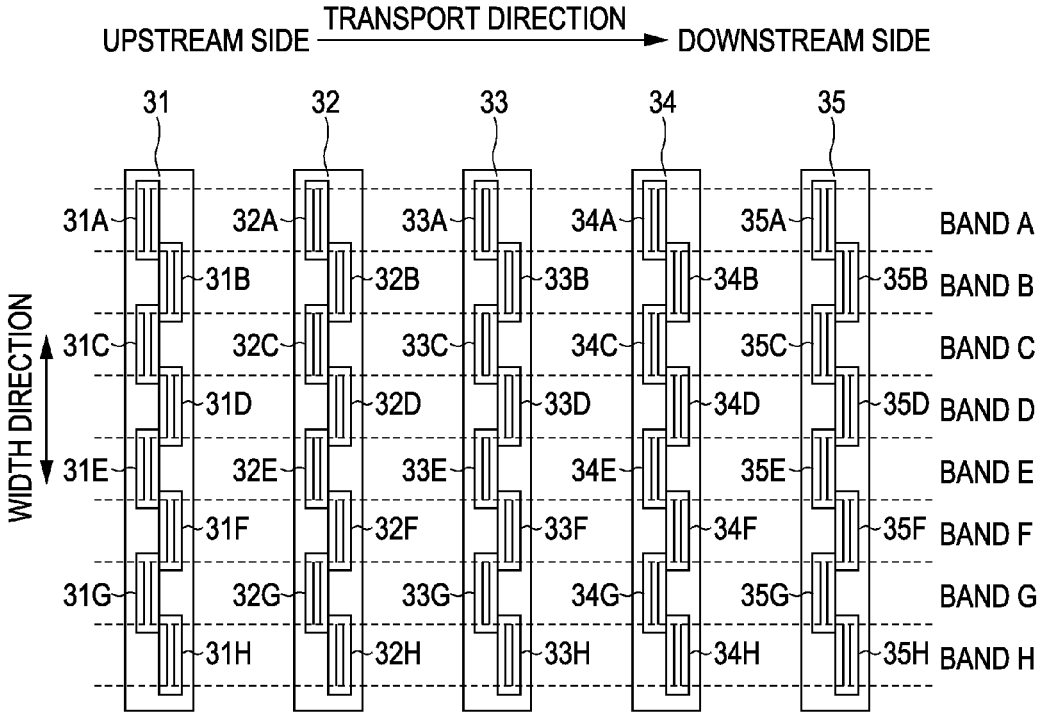
FIG. 3A is a view illustrating the arrangement of a plurality of short length heads of the color ink heads and clear ink head in a head unit.
Figure 3B:
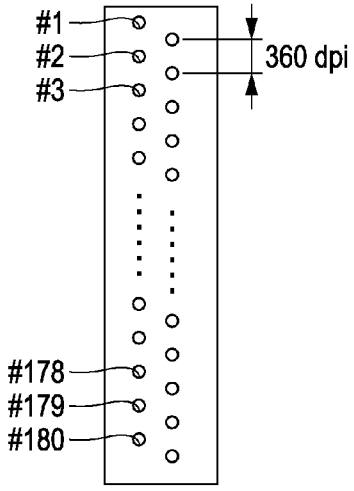
FIG. 3B is a view illustrating the shape of nozzle arrays which are arranged on the undersurface of the respective heads.

FIG. 3A is a view illustrating the arrangement of a plurality of short length heads in the color ink heads 31 to 34 and the clear ink head 35 of the head unit 30. FIG. 3B is a view illustrating the shape of nozzle arrays which are arranged under the respective short length heads. Meanwhile, FIGS. 3A and 3B are views in which the nozzles are virtually viewed from the upper surface.

In the first head 31, 8 short length heads 31A to 31H are arranged in zigzag along the width direction of the medium which crosses the transport direction of the medium. In the same way, in the second head 32, 8 short length heads 32A to 32H are arranged in zigzag along the width direction. In addition, it is the same as in the third head 33, the fourth head 34, and the fifth head 35 (see FIG. 3A). Although each head includes 8 short length heads in an example shown in FIG. 3A, the number of short length heads which are included in each head may be greater or less than 8.

The 8 short length heads of each head are provided such that the positions of which are arranged in the width direction of the medium. That is, the n-th short length head 31*n* of the first head, the n-th short length head 32*n* of the second head, the n-th short length head 33*n* of the third head, the n-th short length head 34*n* of the fourth head, and the n-th short length head 35*n* of the fifth head are provided at the same position in the width direction. These five short length heads are defined as an n-th "head group". In FIG. 3A, eight head groups A to H are formed. In addition, an image is formed in a region which has a specific width in the medium width direction by forming dots in such a way as to eject the UV ink onto the medium from each head group. The region is called "band". For example, a region corresponding to the head group A which includes the short length heads 31A to 35A is a band A, and an image is formed in the region of the band A by ejecting the color ink KCMY from each of the short length heads 31A to 34A and ejecting the clear ink from the short length head 35A. In the same way, images are formed in the regions of the bands B to H by ejecting ink from each of the corresponding head groups B to H. As described above, the image of a print target (an entire image) is formed using the bands A to H which are arranged in the width direction of the medium.

A plurality of nozzle arrays are formed in each of the short length heads (FIG. 3B). Each of the nozzle arrays includes 180 nozzles which eject ink, and the corresponding nozzles are arranged at a uniform nozzle pitch (for example, 360 dpi)

from #1 to #180 along the width direction of the medium. In the case of FIG. 3B, two column nozzle arrays are arranged in parallel, the nozzles of each of the nozzle arrays are provided at positions which are deviated from each other by 720 dpi in the width direction of the medium. Meanwhile, the number of nozzles in 1 column is not limited to 180. For example, 360 nozzles may be included in 1 column, and 90 nozzles may be included in 1 column. In addition, the number of nozzle arrays which is included in each short length head is not limited to 2 columns.

Each of the nozzles is provided with an ink chamber and a piezoelectric element which is a piezoelectric device (both are not shown). The piezoelectric element is driven in response to a drive signal COM which is generated using the unit control circuit 64. In addition, when the piezoelectric element is driven, the ink chamber is expanded and contracted, and ink which is filled in ink chamber is ejected from the nozzle.

In the printer 1, a plurality of types of droplets of ink which have different sizes (the different amount of ink) can be ejected from each of the nozzles based on the magnitude of a pulse which is applied to the piezoelectric element in response to the drive signal COM. For example, it is possible to eject 3 types of ink, that is, large ink droplets corresponding to the amount which can form a large size dot, medium ink droplets corresponding to the amount which can form a medium ink dot, and a small ink droplets corresponding to the amount which can form a small ink dot, from each of the nozzles. In addition, each of the nozzles forms a dot line (raster line) along the transport direction of the medium in such a way that ink droplets are continuously ejected from each of the nozzles onto the medium which is being transported. The relationship between the drive signal COM and the size of a dot which is formed in response to the corresponding drive signal will be described later.

Radiation Unit 40

The radiation unit 40 performs irradiation on UV ink dot which is landed on the medium with UV. The dot which is formed on the medium is irradiated with UV from the radiation unit 40, and is cured. The radiation unit 40 according to the embodiment includes a radiation unit 41.

The radiation unit 41 is provided on the downstream side in the transport direction of the clear ink head 35 (see FIG. 2), and performs irradiation with UV in order to cure the UV ink dot which is formed on the medium using the color ink heads 31 to 34 and the clear ink head 35. The length of the medium width direction of the radiation unit 41 is equal to or greater than the width of the medium.

In the embodiment, the radiation unit 41 includes a Light Emitting Diode (LED) as the light source which is used for the UV irradiation. The LED can easily change irradiation energy by controlling the amplitude of input current. In addition, light source other than the LED, such as a metal halide lamp or the like, may be used as the radiation unit 41. Since the light source of the radiation unit 41 is received within the radiation unit 41, the light source is separated from the clear ink head 35 (and the color ink heads 31 to 34). Therefore, UV irradiated from the light source is prevented from leaking on the lower surface of the clear ink head 35, and the UV ink is cured in the vicinity of the opening of each of the nozzles which are formed on the corresponding under surface, thereby suppressing the occurrence of clogging of the nozzles.

Meanwhile, although only a single radiation unit 41 is provided on the most downstream side in the transport direction as the radiation unit 40 in FIG. 2, a single radiation unit 41 may be configured on the downstream side of each of the color ink heads.

In addition, a radiation unit 42 (not shown) is further configured on the most downstream side of the transport direction, and UV is irradiated from the radiation unit 41 and the radiation unit 42, thus the UV ink dot may be cured using a 2-stage process. For example, the radiation unit 41 performs irradiation with UV using energy to such a degree that the surface of the UV ink dots is cured (supposedly is cured), and the radiation unit 42 performs irradiation with UV using energy to such a degree that entire UV ink dots are cured (is fully cured) in a final stage of transporting the medium. Therefore, when the cure degree of the UV ink dots is adjusted and the UV ink dots are ejected from each of the heads, it is possible to prevent a problem, in that dot landing positions are deviated because UV ink dots of which cure degree is high repel each other, from occurring.

Detector Group

The detector group 50 includes a rotary encoder (not shown), a medium detection sensor (not shown), and the like. The rotary encoder detects the amount of rotation of the upstream side transport roller 23A or the downstream side transport roller 23B. It is possible to detect the amount of transport of the medium based on the result of detection of the rotary encoder. The medium detection sensor detects the position of the front end of the medium which is being supplied.

Controller

The controller 60 is a control unit (control section) which is used to control the printer. The controller 60 includes an interface unit 61, a CPU 62, a memory 63, and a unit control circuit 64.

The interface unit 61 transmits and receives data between the computer 110 and the printer 1 which are the external apparatuses. The CPU 62 is an arithmetic processing unit which is used to control the whole printer 1. The memory 63 secures a region which stores the program of the CPU 62, an operational region, or the like, and includes a RAM, an EEPROM, or the like. In addition, the CPU 62 controls each of the units, such as the transport unit 20 or the like, through the unit control circuit 64 based on the program which is preserved in the memory 63.

Image Print Operation

An image print operation using the printer 1 will be described in brief.

When the printer 1 receives print data from the computer 110, the controller 60 first rotates a medium supply roller (not shown) using the transport unit 20, and transmits a medium to be printed on the belt 24. The medium is transported on the belt 24 at a uniform speed without stopping, and passes through each of the head unit 30 and the radiation unit 40.

At this time, the color ink KCMY is intermittently ejected from each of the nozzles of the color ink heads 31 to 34, thus a letter or an image which include the color ink dots is formed on the medium. In addition, the clear ink CL is intermittently ejected from each of the nozzles of the clear ink head 35, thus clear ink dots are formed in a specific pixel. In addition, UV is irradiated from the radiation unit 41 of the radiation unit 40, thus the color ink dots and the clear ink dots harden. In this way, an image is printed on the medium.

Finally, the controller 60 performs medium discharge on the medium on which the print of the image ends.

Description of Drive Signal COM

Figure 4:
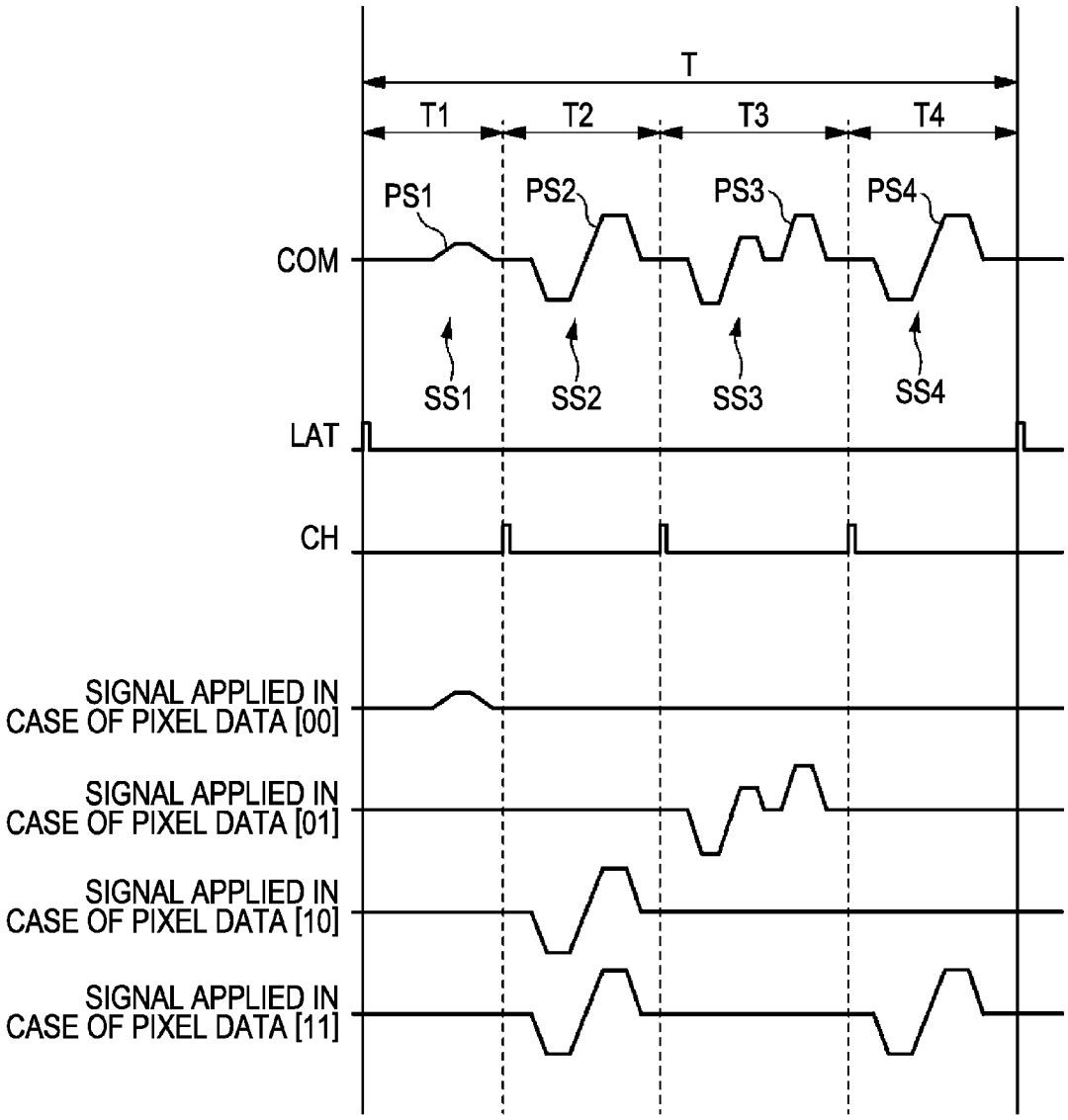
FIG. 4 is a view illustrating a drive signal.

FIG. 4 is a view illustrating a drive signal COM. As shown in the drawing, the drive signal COM is generated using a period T, in which the rising timing of the latch signal LAT is used as a delimiter, as a single unit. Meanwhile, the latch signal is a signal which is used as a landmark of the start or end of other. The period T includes intervals T1 to T4 which are divided by the rising timings of the latch signal LAT and a change signal CH. In addition, each of the intervals T1 to T4 includes a drive pulse which will be described later. The period T which is a repetition period corresponds to a period during which the nozzles of a single pixel move on the medium. For example, in a case in which print resolution is 720 dpi, the period T corresponds to a period during which the medium is transported by 1/720 inch. In addition, drive pulses PS1 to PS4 in the respective intervals, which are included in the period T, are applied to the piezoelectric elements based on the pixel data SI which is data indicative of the ink dots which are formed for each pixel, thus it is possible to adjust the amount of ink which is ejected from the nozzles, and it is possible to express an image which includes a plurality of grayscales.

The drive signal COM includes a first waveform section SS1 which is generated at the interval T1, a second waveform section SS2 which is generated at the interval T2, a third waveform section SS3 which is generated at the interval T3, and a fourth waveform section SS4 which is generated at the interval T4 in the repetition period. Here, the first waveform section SS1 has a drive pulse PS1. In addition, the second waveform section SS2 has a drive pulse PS2, the third waveform section SS3 has a drive pulse PS3, and the fourth waveform section SS4 has a drive pulse PS4.

When it is assumed that the pixel data SI is data which is expressed using two bits and in a case in which the pixel data SI is [00], the first interval signal SS1 of the drive signal COM is applied to the piezoelectric element PZT, and the piezoelectric element PZT is driven using the drive pulse PS1. If the piezoelectric element PZT is driven in response to the drive pulse PS1, pressure variation of the degree in which ink is not ejected occurs in the ink, ink meniscus (the free surface of ink which is exposed at the portion of a nozzle) slightly vibrates.

In a case in which the pixel data SI is [01], the third interval signal SS3 of the drive signal COM is applied to the piezoelectric element PZT, the piezoelectric element PZT is driven in response to the drive pulse PS3. If the piezoelectric element PZT is driven in response to the drive pulse PS3, a small degree amount of ink is ejected, thus a small size dot is formed on the medium.

In a case in which the pixel data SI is [10], the second interval signal SS2 of the drive signal COM is applied to the piezoelectric element PZT, thus the piezoelectric element PZT is driven in response to the drive pulse PS2. If the piezoelectric element PZT is driven in response to the drive pulse PS2, a middle degree amount of ink is ejected, thus a middle size dot is formed on the medium.

In a case in which the pixel data SI is [11], the second interval signal SS2 and the fourth interval signal SS4 of the drive signal COM is applied to the piezoelectric element PZT, thus the piezoelectric element PZT is driven in response to the drive pulse PS2 and the drive pulse PS4. If the piezoelectric element PZT is driven in response to the drive pulse PS2 and the drive pulse PS4, a large size dot is formed on the medium.

Figure 5:
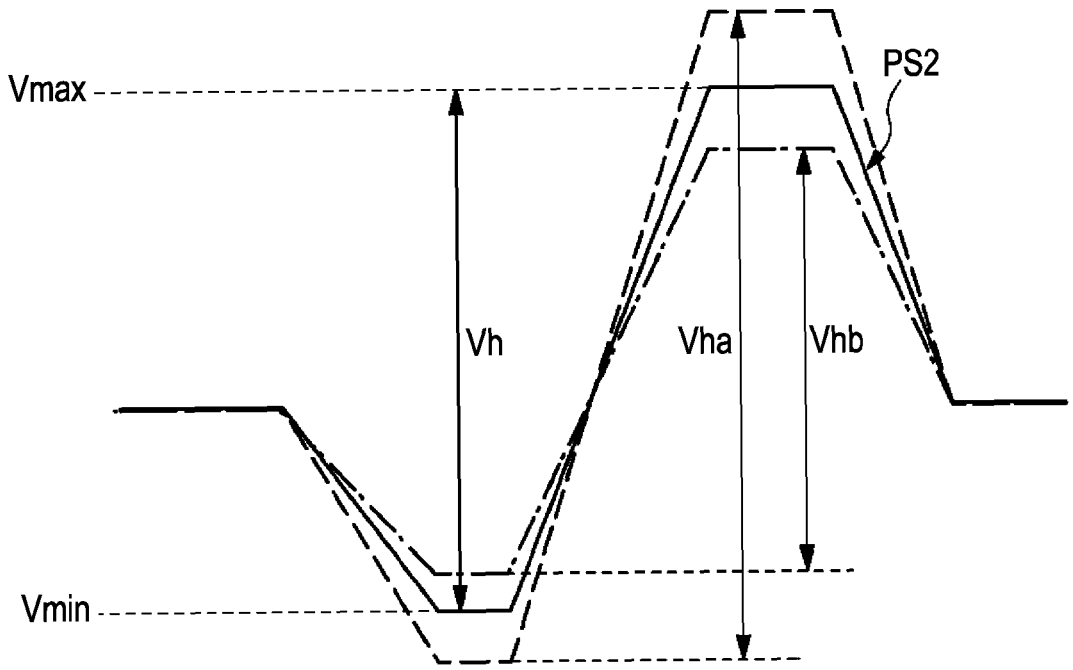
FIG. 5 is a view illustrating the amplitude of a drive pulse.

In addition, the size of each type dot (the amount of ejected ink for each of the small, middle, and large size dots) is defined based on the amplitude of the waveform of the drive pulse. FIG. 5 is a view illustrating the amplitude of the drive pulse. FIG. 5 is an example in which the drive pulse PS2 used to form the above-described dot is enlarged. The amplitude of the drive pulse PS2 is expressed using potential difference Vh between the highest voltage Vmax and the lowest voltage Vmin, and the actual drive amount of the piezoelectric element (the amount of expansion and contraction of the ink chamber) is determined based on the amplitude of the Vh. That is, the amount of ink which is ejected from the nozzles is changed by changing the size of the amplitude Vh of the pulse waveform. For example, if the amplitude of the drive pulse PS2 is Vh, an ink droplet of 3 pl is ejected and a dot of 3 pl (middle size dot) is formed. In addition, if the amplitude of the drive pulse PS2 is changed to Vha which is expressed using a dashed line in FIG. 5 (Vha>Vh), an ink of 3.5 μl is ejected, thus a middle size dot, in which the amplitude of the drive pulse PS2 is slightly larger than Vh is formed. In addition, if the amplitude of the drive pulse PS2 is changed to Vhb which is expressed using a dashed-dotted line in FIG. 5 (Vh>Vhb), an ink of 2.5 pl is ejected, thus a middle size dot, in which the amplitude of the drive pulse PS2 is slightly smaller than Vh is formed.

As described above, even when the same type dot (the middle size dot in the above-described example) is formed, it is possible to adjust the size of a dot (dot diameter) to be formed by changing the size of the amplitude of the drive pulse. It is the same as in a case in which a small size dot or a large size dot is formed.

Image to be Printed

Subsequently, an image to be printed using the printer 1 will be described. As described above, in the printer 1, an image is printed in such a way that UV ink dots are formed in the respective bands A to H corresponding to the eight head groups A to H. When printing is being performed, print data (pixel data) is generated based on the data of an original image, and ink dots having specific sizes are applied to pixels which are designated based on the corresponding print data (pixel data), thereby forming an image. Therefore, if the ink dots are accurately formed in positions (pixels) which are designated based on the print data, it is possible to obtain an image with excellent image quality. However, in a case in which the ink dots are formed in positions which are deviated from the positions (pixels) designated using print data, the image quality of an image to be formed is deteriorated.

Figure 6A:
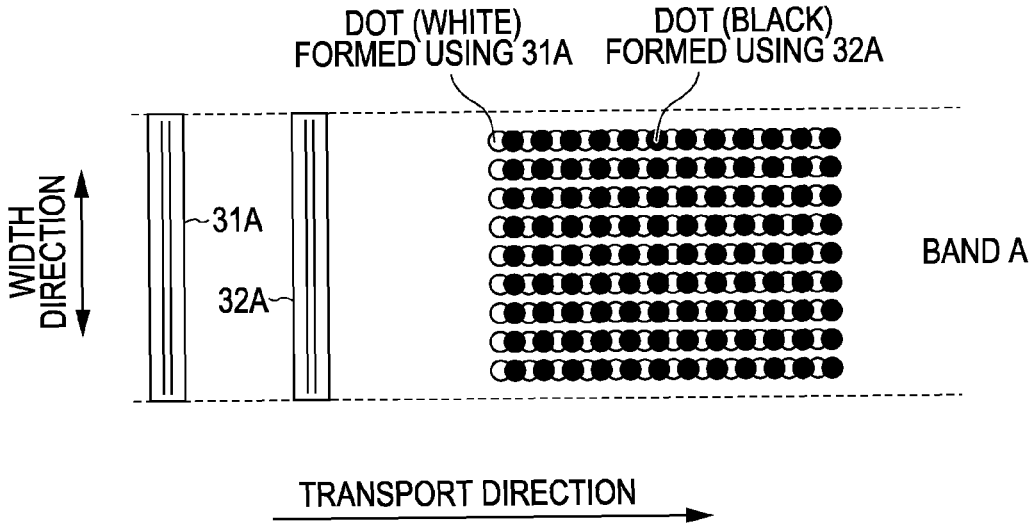
FIG. 6A is a view illustrating an image obtained when UV ink dots are landed on an accurate position.
Figure 6B:
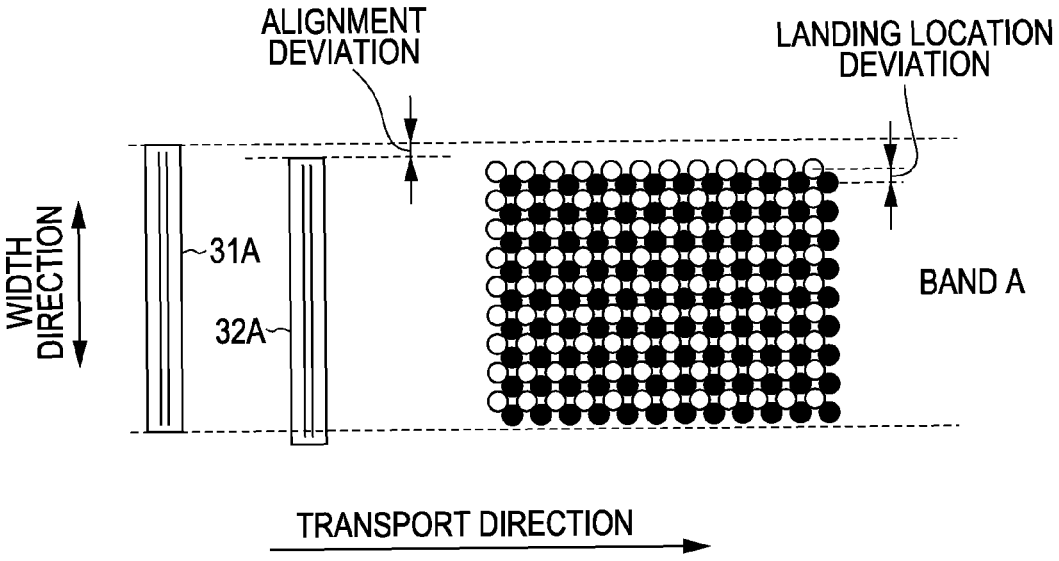
FIG. 6B is a view illustrating an image obtained when UV ink dots are not landed on an accurate position.

FIG. 6A is a view illustrating an image obtained when the UV ink dots are landed on accurate positions. FIG. 6B is a view illustrating an image obtained when the UV ink dots are not landed on the accurate positions. Both the cases shown in both drawings illustrate an example of a case in which an image is printed in the band A using the short length head 31A (hereinafter, referred to as a first head 31A) and the short length head 32A (hereinafter, referred to as a second head 32A) of the head group A. In the drawings, dots which are expressed using white circles are dots which are formed using the first head 31A, and dots which are expressed using black circles are dots which are formed using the second head 32A. In FIGS. 6A and 6B, the number and the size of the dots to be formed are schematically illustrated for purposes of illustration, and dots which are actually formed when printing is being performed are different from these.

In FIG. 6A, the relationship between the positions of two short length heads 31A and 31B is normal (the width direction is not deviated), and FIG. 6A shows the shapes of dots formed when the medium is transported straight in the transport direction, that is, when there are few factors which cause the landing positions of the dots to be deviated. In this case, the ink dots which are ejected from both heads are accurately landed on pixels which are designated based on the print data. The positions of the respective dots shown in FIG. 6A indicate accurate landing points. As shown in the drawing, when the width directions of the first head 31A and the second head 32A match, in other words, when the arrangements of the heads are not deviated from each other, deviation does not occur in the landing positions in the width direction between the dots (white circles) formed using the first head 31A and the dots (black circles) formed using the second head 32A.

In contrast, FIG. 6B shows the shapes of dots formed when the position of the second head 32A of the two short length heads is deviated from the medium width direction, in other words, when the arrangement of the head is deviated. The dots (white circles) formed using the first head 31A, in which deviation does not occur, are landed on the same positions shown in FIG. 6A. Meanwhile, the dots (black circles) formed using the second head 32A, in which arrangement deviation occurs, are landed on positions which are deviated from the width direction of the medium compared to those shown in FIG. 6A. That is, dots shown using the black circles are formed in positions which are deviated from the pixels designated based on the print data. Meanwhile, such deviation of the landing positions occurs due to the deviation of the arrangement of the head or the influence of meandering which occurs when the medium is transported.

When FIG. 6A is compared with FIG. 6B, since the landing positions of the dots (black circles) formed using the second head 32A are different in the band A, the impressions of both images are differently viewed. For example, in FIG. 6A and FIG. 6B, the color difference in images is large. Since the landing positions of the ink dots are deviated, the center distances from the white circles and the black circles vary, thus differences result in a method of overlapping each color ink dot, thereby generating color difference.

In addition, in FIG. 6A and FIG. 6B, difference occurs in glossiness (glossiness difference). Since the landing positions of the ink dots are deviated, a region in which dots are "tightly" formed and a region in which dots are "sparsely" formed occur on a medium surface. Since an image surface is near to a planar shape in a section in which dots are "tightly" formed, light which is incident on an image surface (a medium surface) is regularly reflected thereby increasing the glossiness. In contrast, since dots are dispersed in a section in which dots are "sparsely" formed, the image surface is rough, thus light which is incident on the image surface (the medium surface) is scattered and reflected, thereby decreasing the glossiness. Therefore, the image surface is viewed in such a way that the glossiness partially varies.

As described above, if deviation occurs in the landing positions of the ink dots, the color difference or the glossiness difference increases in some positions, thereby deteriorating image quality. That is, if the color difference or the glossiness difference increases between bands of which the respective head groups are in charge, the quality of the printed image is deteriorated. Meanwhile, such deviation of the landing positions of the ink dots is due to the attachment error of the head unit 30 in a stage of manufacturing the printer 1 (deviation of the arrangement), the transport characteristics of the transport unit 20, or the like, and is a unique problem which is generated for each manufactured printer. Therefore, in order to print an image with excellent image quality, it is necessary to compensate for each printer.

First Embodiment

In first embodiment, in order to suppress the above-described deterioration in the image quality of a printed image, an image having little color difference and excellent image quality is printed throughout the whole image by compensating for color difference in each band. In detail, the dot diameters of dots which are formed on the medium is changed by adjusting the size of the pulse amplitude Vh of the drive signal COM (refer to FIG. 5). If the sizes of the dots are changed, the proportion of dots, which are formed in a specific region of the medium, or the method of overlapping the dots are changed, and, accordingly, the color difference between the bands varies.

Figure 7A:
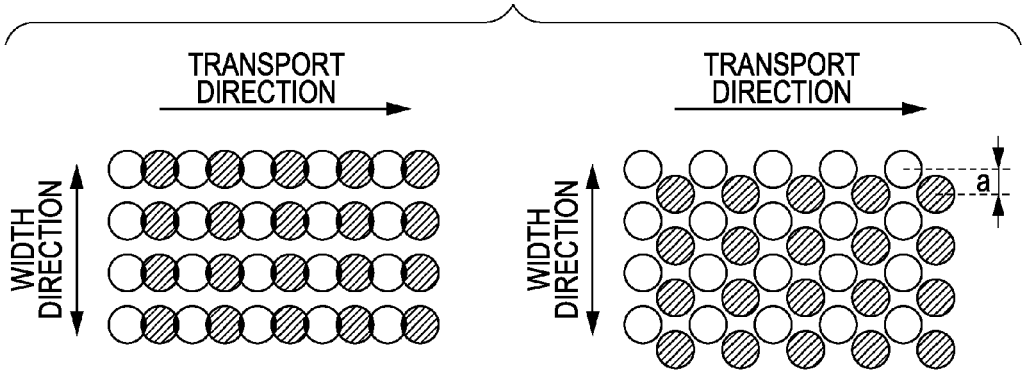
FIGS. 7A and 7B are views which are used to compare cases in which images are printed by changing the dot diameter of an ink dot.
Figure 7B:
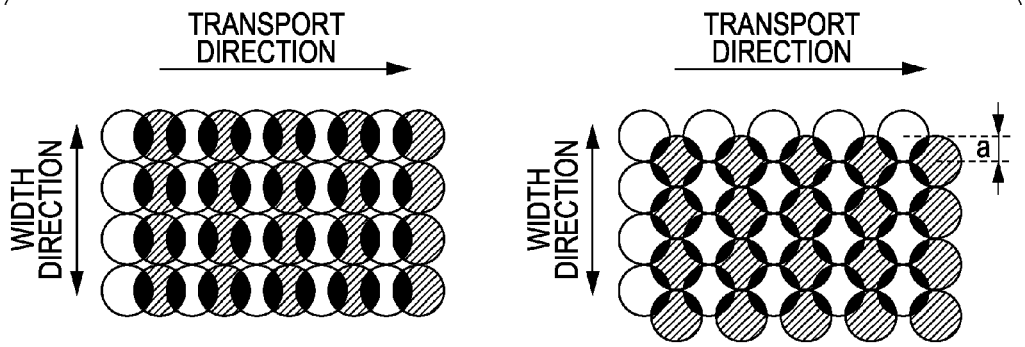

FIGS. 7A and 7B are views illustrating cases in which images are printed by changing the dot diameters of ink dots and which are compared with each other. FIG. 7A shows an example of a case in which printing is performed using a given specific dot diameter, and FIG. 7B shows an example of a case in which printing is performed using a dot diameter which is greater than that of FIG. 7A. In both drawings, views shown on the left show a case in which the deviation of dot landing positions does not occur, and views shown on the right show a case in which the deviation of dot landing positions occurs in the width direction by a. In addition, dots expressed using white circles in the drawing and dots expressed using oblique lines are ejected from different heads (short length heads), and the portions which are filled with black express portions in which dots are overlapped with each other.

In FIG. 7A, when the deviation of the landing positions does not occur (left view), the overlap of dots is viewed. However, when the deviation of the landing positions occurs (right view), the overlap of dots is not viewed. That is, in the example of FIG. 7A, difference easily occurs in the method of overlapping dots formed on the medium due to the deviation of the landing positions. For example, compared to the right view, areas, in which dots are overlapped, increase only the region of the black portions in the left view of FIG. 7A. This means that the proportion that the ink dots of each of the color KCMY are overlapped with each other varies when printing is actually performed, and the color difference of an image to be formed is noticeable.

In contrast, in FIG. 7B, it is difficult to generate difference in the method of overlapping dots which are formed on the medium when the deviation of the landing positions does not occur (left view) and when the deviation of the landing positions occurs (right view). For example, in the left view and the right view of FIG. 7B, the sums of areas of black portions of the dots are equal, thus the proportions that the dots are overlapped with each other on the medium are equal. When printing is actually performed, if regions in which different color ink dots are overlapped with each other are equal, colors which are expressed using these ink dots are viewed as the same color. Therefore, even though the deviation of dot positions occurs, the color difference in colors of an image to be printed is hardly noticeable.

As described above, even when the deviation of dot landing positions occurs, the size of the dot diameter varies, thus influence on the color difference of an image is different. However, when printing is actually performed, the amount of ink which is ejected onto the medium per a specific region is partially different depending on a grayscale value which is instructed in the print data, thus it is difficult to say that color difference decreases if integrally increasing a dot diameter.

Here, in the embodiment, the pulse amplitude Vh (the drive signal COM) is adjusted such that a dot diameter which is formed when printing is performed is an optimal size. Therefore, even when the deviation of dot landing position occurs due to the deviation of arrangement or the like, an image is printed with excellent image quality by causing the color difference between bands to be unnoticeable.

Outline of Dot Diameter Adjustment

When printing is performed using the printer 1, the outline of an operation of performing printing by causing the color different which occurs between bands to be equal to or less than a given value (a defined value) or causing the color difference to be minimum will be described.

In the embodiment, an image is printed while adjusting the size of a dot diameter using two processes, that is, a detection process and a print process. In the detection process, the amplitude Vh of a pulse waveform is changed using the printer 1 (that is, the dot diameter is changed), and the color of a test pattern to be printed is measured, thereby calculating color difference which actually occurs for each band. Thereafter, a dot diameter obtained when the calculated color difference between the corresponding bands is equal to or less than the defined value or a dot diameter obtained when the calculated color difference is the minimum is selected, and the waveform of the drive signal COM (the amplitude Vh of the pulse waveform) which is used to form the dot diameter is preserved in the storage medium, such as the memory 63 of the printer 1. Subsequently, in the print process, the ink dots are ejected from all the heads such that the dot diameter is the corresponding dot diameter preserved in the detection process, thus image printing is actually performed. Hereinafter, each process will be described in detail.

Detection Process

Figure 8:
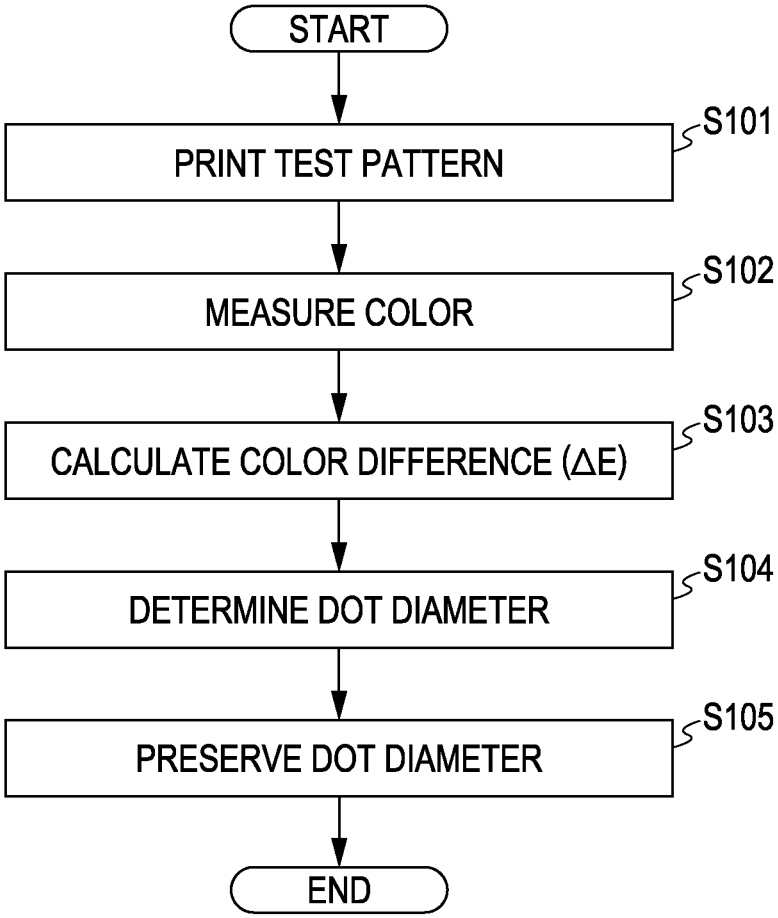
FIG. 8 is a flowchart illustrating the flow of a detection process according to a first embodiment.

In the detection process, color measurement is performed by printing a test pattern including a plurality of patches, and the pulse amplitude Vh which is used to define the size of the ink dot (dot diameter) to be ejected from each head is defined based on the results thereof. When printing is performed, the Vh is commonly used for all the heads of the head unit 40. FIG. 8 shows a flowchart illustrating the flow of the detection process. The detection process is performed by executing the process of steps S101 to S105.

First, a test pattern is printed in step S101. The test pattern is formed by printing the plurality of patches using color ink KCMY in the eight bands A to H, respectively. In addition, the test pattern is printed on a medium which is the same as the medium which is actually printed.

Figure 9:
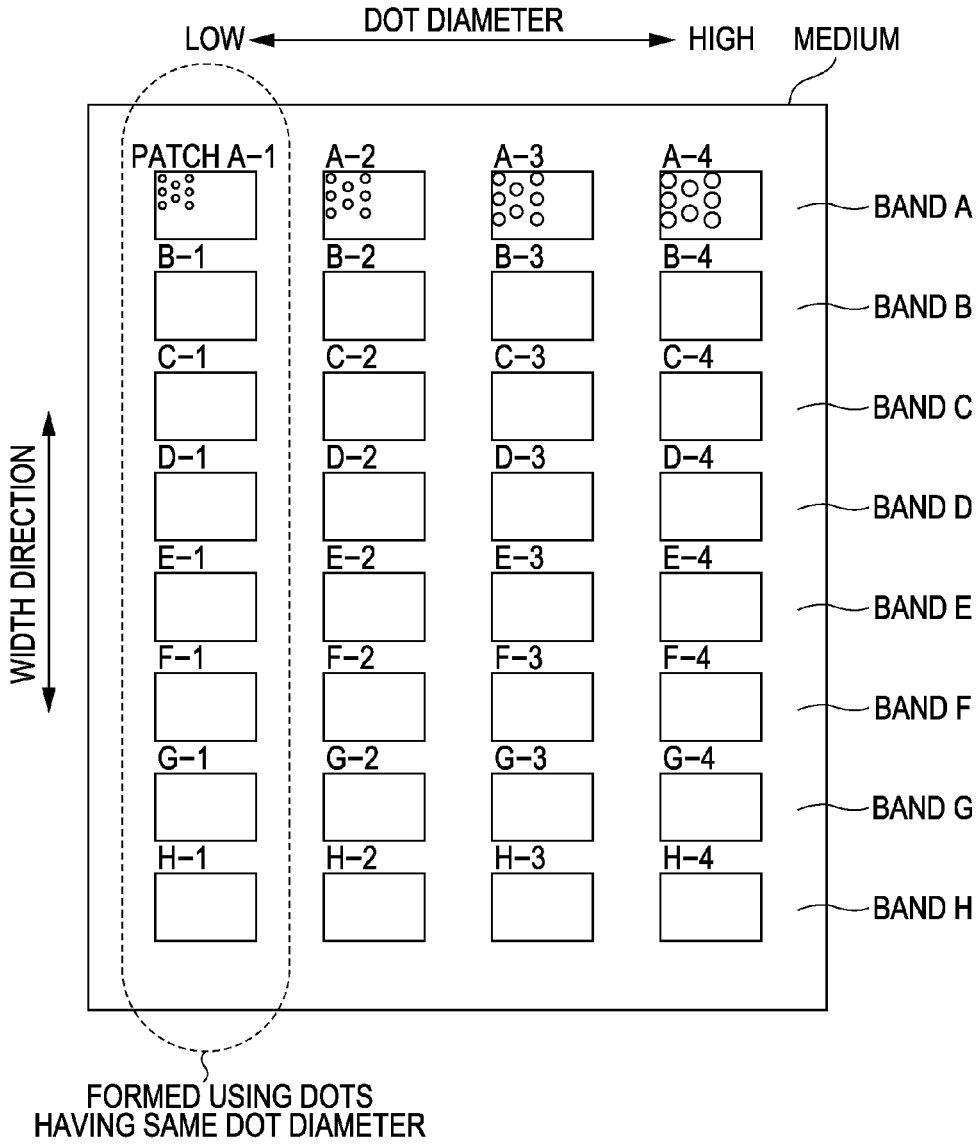
FIG. 9 is a view illustrating an example of a test pattern which is printed according to the first embodiment.

FIG. 9 shows an example of the test pattern which is printed in the embodiment. As shown in the drawing, the test pattern which is printed in the embodiment includes a plurality of rectangular patches for each band. For example, in FIG. 9, each of the bands A to H includes four patches 1 to 4, and 8×4=32 patches are formed in total. Hereinafter, the patch 1 of the band A is expressed as "patch A-1". If symbols A-1, A-2, . . . , H-4 indicative of the corresponding patches are printed in the vicinity of the respective patches as shown in FIG. 9, the confusion of data hardly occurs when the color measurement of a subsequent process is performed in step S102. In addition, the shape of the patch may not be a rectangle.

Each of the patches is printed using a specific grayscale value based on specific color by ejecting UV ink from each of the first to fourth heads. Here, for purposes of illustration, it is assumed that each patch is formed using only middle size dots. For example, the patch A-1 is formed using the middle size dots of four types of color ink KCMY. In addition, the patches included in the same band are formed such that the dot diameters of the middle size dots gradually increase by gradually changing the size of the pulse amplitude Vh of the drive signal COM (refer to FIG. 5). That is, the smallest middle size dots are formed using the pulse waveform of the amplitude Vh1 in the patch 1 of the patches 1 to 4. In the same way, the middle size dots are formed such that the dot diameters thereof are gradually increases using the pulse waveform of the amplitude Vh2 (Vh1<Vh2) in the patch 2 and using the pulse waveform of the amplitude Vh3 (Vh2<Vh3) in the patch 3. In addition, the largest middle size dots are formed using the pulse waveform of the amplitude Vh4 (Vh3<Vh4) in the patch 4. For example, in the band A, the patch A-1 is formed using middle size dots of an ink of 2.5 pl, the patch A-2 is formed using middle size dots of 3.0 pl, the patch A-3 is formed using middle size dots of 3.5 pl, and the patch A-4 is formed using middle size dots of 4.0 pl. Meanwhile, here, as the ejected ink amount is larger, dots having greater dot diameters are formed when ink is landed on the medium.

In addition, all the patches to which the same numerical is attached are formed using dots which have the same dot diameter. For example, all of eight patches A-1 to H-1 which are included in a region surrounded using a dashed line of FIG. 9 are formed using a middle size dot of 2.5 pl. Meanwhile, although four types of patches are formed in the respective bands using four types of dot diameters in FIG. 9, it is possible to form five or more types of patches in the respective bands while changing the sizes of dot diameters to smaller values by adjusting the size of the pulse amplitude Vh of the above-described drive signal COM. It is possible to improve the accuracy of image compensation by increasing the types of the patches (types of the sizes of the dot diameters) in the respective bands.

Subsequently, color measurement is performed on the formed patches, respectively, in step S102. The color measurement is performed on the patches using a color measurement device. The color measurement device is a spectroscopic color meter which is used to measure the color specification value of the specific range of an image and obtain the color specification value as the color measurement value of the specific range, and it is possible to use a general spectroscopic measurement unit. The color measurement value which is obtained for each patch is expressed as each color component value of an L*a*b* color space, and the corresponding color measurement value is temporarily preserved in the memory 63 or the like. For example, a color measurement value which is obtained from the patch A-1 is preserved as $(E_{A1})=(L_{A1}^*, a_{A1}^*, b_{A1}^*)$. Meanwhile, the color measurement value may be measured as each color component of another color space (for example, an XYZ color space or an L*u*v*color space).

Subsequently, the color difference ΔE between patches which are formed using the same dot diameter is calculated in step S103. As described above, since color varies in an image formed using a head group in which the deviation of the arrangement occurs, there may be a case in which the patches which are formed using the same dot diameter have different color measurement values between bands according to a state of the head group which forms the patches. Here, the difference in sizes of the color measurement values between bands is calculated as color difference. In the embodiment, the color difference ΔE is calculated by comparing the difference between the average value of the color measurement values of the plurality of patches formed using the same dot diameter with the color measurement value of individual patch.

First, with respect to an n-th patch (patch m−n) included in a band m, the difference $\Delta E_{mn}$ between the average value of the color measurement values of patches (the n-th patches of the respective bands) which are formed using the same dot diameter and the color measurement value of the patch m−n is obtained. $\Delta E_{mn}$ is calculated using the following Equation 1.

$$\Delta E_{mn}=\sqrt{(L_{mn}^*-L_{nave}^*)^2+(a_{mn}^*-a_{nave}^*)^2+(b_{mn}^*-b_{nave}^*)^2} \quad (1)$$

In Equation 1, $L_{mn}^*$ indicates an L* value which is measured from the patch m−n, and $L_{nave}^*$ indicates the average value of the L* values ($L_{An}^*$, $L_{Bn}^*$, to, $L_{Hn}^*$) of the n-th patches of the eight bands. It is the same as in $a_{mn}^*$, $a_{nave}^*$, $b_{mn}^*$, and $b_{nave}^*$.

In addition, the difference between the maximum value $\Delta E_{n(max)}$ and the minimum value $\Delta E_{n(min)}$ of $\Delta E_{\Delta n}$ to $AE_{Hn}$ which are obtained with respect to the respective n-th patches of the bands A to H is calculated as the color difference $\Delta E_n$ of the n-th patch.

Figure 10:
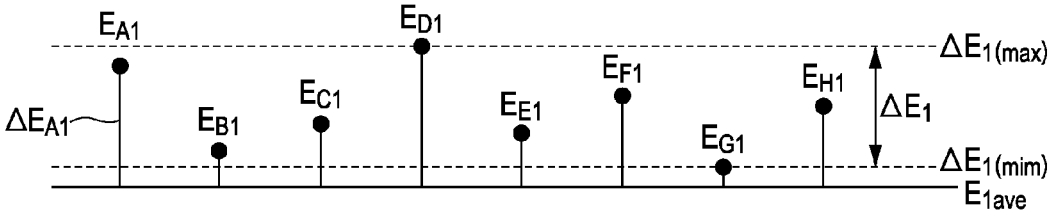
FIG. 10 is a view illustrating a method of calculating the color difference of the first patch of each band in detail.

FIG. 10 shows a view illustrating a method of calculating the color difference $\Delta E_1$ of the first patch of each band in detail. First, eight color measurement value data $E_{A1}$, $E_{B1}$, to, $E_{H1}$, which are obtained from the patches (the first patches of the respective bands) A-1, B-1, to, H-1 which are included in the region surrounded using dashed line in FIG. 9 and which are formed using the same dot diameter, are measured. $E_{A1}$ to $E_{H1}$ are data which includes variation as shown in FIG. 10. In addition, difference $\Delta E_{A1}$ to $\Delta E_{H1}$ between the respective color measurement value data and the average $E_{1ave}$ of the corresponding eight data are calculated. Meanwhile, as shown in Equation 1, $\Delta E_{mn}$ is calculated as an absolute value. Subsequently, the minimum value and the maximum value of the calculated eight data $\Delta E_{A1}$ to $\Delta E_{B1}$ are obtained. In an example shown in FIG. 10, the maximum value $\Delta E_{1(max)}$ is $\Delta E_{D1}$, and the minimum value $\Delta E_{1(min)}$ is $\Delta E_{G1}$. In addition, the difference $\Delta E_{D1}-\Delta E_{G1}$ between the maximum value and the minimum value is calculated as the color difference $\Delta E_1$ between the first patches of the respective bands.

Meanwhile, the color difference $\Delta E_n$ may be calculated as the average value of $\Delta E_{An}$ to $\Delta E_{Hn}$. That is, $\Delta E_n$ may be calculated as $(\Delta E_{An}+\Delta E_{Bn}+$ to $+\Delta E_{Hn})/8$.

A dot diameter, obtained when the color difference $\Delta E_n$ is equal to or less than a given value (a defined value) or when the corresponding color difference $\Delta E_n$ is the minimum vale, is selected and determined as a dot diameter which is used when printing is actually performed in step S104. The determined dot diameter is preserved in the memory 63 in step S105. For example, in the case of FIG. 9, in the eight bands A to H, the color difference $\Delta E_1$ to $\Delta E_4$ of the first to fourth patches are calculated, respectively. The dot diameter (in the above-described example, the middle size dot having any one of the sizes 2.5 pl, 3.0 pl, 3.5 pl, and 4.0 pl), obtained when $\Delta E$ of the calculated four color difference is equal to or less than a specific value (for example, the color difference is 10) or is the minimum value, is determined as the dot diameter (the middle size dot) which is used when printing is actually performed. In other words, the pulse amplitude Vh which can be used to form an optimal dot diameter is determined.

Here, the color difference is noticeable in an actual image when the color difference which occurs between the adjacent bands (for example, between the bands B and C or between the bands D and E) is large. Therefore, a method of using the color difference between the adjacent bands as dot diameter selection reference may be used.

In this case, with respect to the eight bands A to H, the color difference between the adjacent bands are calculated, respectively, and a dot diameter, obtained when the color difference between the corresponding adjacent bands is equal to or less than the defined value or when the corresponding color difference is the minimum vale, is selected. In detail, seven color difference, that is, the color difference $|E_{A1}-E_{B1}|$ between the adjacent bands A and B, the color difference $|E_{B1}-E_{C1}|$ between the bands B and C, . . . , the color difference $|E_{G1}-E_{H1}|$ between the bands G and H, are calculated, and a dot diameter, obtained when each of the calculated color difference is equal to or less than the defined value (for example, the color difference is 10) or when the average value of the color difference is the minimum value or is equal to or less than the defined value, is selected as a dot diameter which is used when printing is actually performed in step S104. The selected dot diameter is preserved in the memory 63 in step S105.

In addition, an image is formed using dots each having the dot diameter, obtained when the color difference $\Delta E$ between the bands is equal to or less than the defined value or is the minimum value, thus the color difference between the bands is not noticeable, thereby enabling the whole image to be printed with excellent image quality.

Meanwhile, each of the patches is formed using only middle size dots in the above-described example. However, when printing is actually performed, for example, when printing is performed using two-bit pixel data, an image is formed using dots having a plurality types of sizes, such as small size dots, middle size dots, large size dots, and the like. Here, when a test pattern is formed, small size dots, middle size dots, and large size dots are mixed in a single patch. That is, in the above-described process in step S101, a test pattern is formed with respect to the sets of small, middle, and large size dots which are formed in the cases of the amplitudes Vh1 to Vh4 of the drive signal COM. For example, the patch A-1 includes small size dots, middle size dots, and large size dots which are formed in the region of the band A using the pulse waveform having the amplitude Vh1, and the patch B-2 includes small size dots, middle size dots, and large size dots which are formed in the region of the band B using the pulse waveform having the amplitude Vh2.

The processes in steps S102 to S105 are performed on the test pattern, thus the size of each dot (the drive signal COM having the amplitude Vh of the pulse waveform), obtained when the color difference $\Delta E$ between the bands is equal to or less than the defined value or is the minimum value, is determined when printing is performed using a plurality types of dots. When printing is actually performed, small size dots, middle size dots, and large size dots are formed using the determined drive signal COM having the corresponding pulse amplitude Vh, the color difference between the bands is not noticeable, thus it is possible to print the whole image with excellent image quality.

Print Process

In the print process, an image is actually printed using the printer 1 by a user. In this case, printing is performed using the drive signal COM having the amplitude Vh of the pulse waveform which is the dot diameter which is determined in the detection process.

Figure 11:
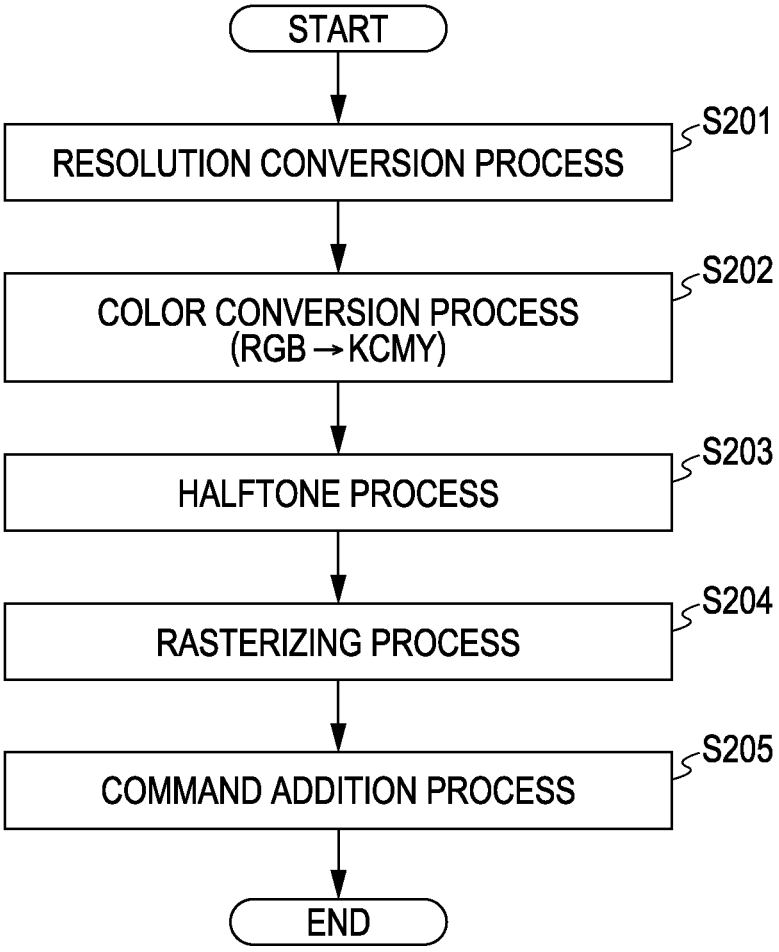
FIG. 11 is a flowchart illustrating the flow of a process which is performed using a printer driver in the printing process.

If the user of the printer 1 instructs to print an image which is drawn using an application program, the printer driver of the computer 110 is run. The printer driver receives image data from the application program, converts the image data into print data in a format which can be interpreted by the printer 1, and outputs the print data to the printer. When the image data received from the application program is converted into the print data, the printer driver performs a resolution conversion process, a color conversion process, a halftone process, and the like. FIG. 11 shows a view illustrating the flow of a process which is performed using the printer driver of the print process.

First, a process (resolution conversion process) of converting the image data (text data, image data, or the like) which is output from the application program into resolution (print resolution) which is used when the image data is printed on the medium is performed in step S201. For example, when the print resolution is designated to 720×720 dpi, the vector type image data which is received from the application program is converted into bitmap type image data having a resolution of 720×720 dpi.

Meanwhile, each pixel data of the image data, obtained after the resolution conversion process is performed, is RGB data of each grayscale (for example, 256 grayscales) which is expressed using an RGB color space.

Subsequently, a color conversion process of converting the RGB data into the data of a CMYK color space is performed in step S202. The image data of the CMYK color space is data corresponding to ink color included in the printer. The color conversion process is performed based on a table (a color conversion Look-Up Table (LUT)) in which the grayscale value of the RGB data is associated with the grayscale value of the CMYK data.

Meanwhile, the pixel data, obtained after the color conversion process is performed, is 8-bit CMYK data having 256 grayscales which are expressed using the CMYK color space.

Subsequently, the halftone process of converting a high grayscale number of data into a grayscale number of data which can be formed using the printer is performed in step S203. For example, data indicative of 256 grayscales is converted into 1-bit data indicative of 2 grayscales or 2-bit data indicative of 4 grayscales by performing the halftone process. In the halftone process, a dither method, a γ correction, an error diffusion method, or the like is used. The data on which the halftone process is performed has resolution which is the same as the print resolution (for example, 720×720 dpi). The image data, obtained after the halftone process is performed, corresponds to 1-bit or 2-bit pixel data for each pixel. The pixel data is data indicative of dot formation situation (the presence or non-presence of a dot, the size of a dot) for each pixel.

Thereafter, the rasterizing process of rearranging the pixel data arranged in a matrix in order of data which should be transmitted to the printer 1 for each pixel data is performed in step S204. For example, the pixel data is rearranged based on the arrangement order of the nozzles of each of the nozzle arrays.

A command addition process of adding command data based on a printing method to the data on which the rasterizing process is performed in step S205. As the command data, there is, for example, transport data indicative of transport speed of a medium, or the like.

The print data generated through these processes is transmitted to the printer 1 using the printer driver. In addition, printing is actually performed using the printer 1. When printing is performed, the drive signal COM having a specific pulse amplitude Vh which is preserved in the memory 63 is applied to the piezoelectric element of each nozzle in order to form a dot, having the dot diameter which is determined in the detection process and which causes the color difference between the bands to be the minimum value. Therefore, the diameters of ink dots (small size, middle size, and large size dots) which are ejected from all the heads (nozzles) are uniform, thus the color difference between the bands is unnoticeable.

Meanwhile, in the above-described example, the configuration in which various types of processes of the print process are executed using the printer driver which is installed in the computer 110 has been described. However, the printer driver may be installed in the controller 60 of the printer 1, and these processes may be performed using the printer 1.

Summary of First Embodiment

In the first embodiment, in the detection process, a test pattern, which includes a plurality of patches using dots having different dot diameters and being formed for each head group, is printed for each band, the color difference of the patches in each band is obtained based on the result obtained by performing the color measurement on the corresponding test pattern. The corresponding color difference is indicative of the difference in color measurement values of the patches, which are formed for each band using dots having the same dot diameter, of the plurality of patches. In addition, the dot diameter, obtained when the color difference between the bands is equal to or less than the defined value or the color difference is the minimum value, is selected as a dot diameter which is used to perform printing, and is preserved in the memory or the like. Thereafter, in the print process, ink is ejected from each of the head groups such that the dot diameter of the ink is the determined dot diameter.

Therefore, in the line head type printing apparatus, such as the printing apparatus 1, the color difference between the bands is unnoticeable, thus it is possible to print an image with excellent image quality.

Second Embodiment

According to the method of the first embodiment, attention is given to the color difference between the bands, and the color difference is caused to be as small as possible by adjusting the drive signal COM such the dot diameter has a specific size, thus it is possible to improve the image quality of an image to be printed. However, if the dot diameter is determined by giving attention to only the color difference between the bands, the color difference can be unnoticeable but there may be a case in which the graininess of the image is deteriorated. The graininess indicates the degree of surface roughness of the whole image. For example, if ink dots (particles) which are formed on the medium are too large, individual particles are noticeable, thereby giving an impression in which the image is rough. Therefore, when printing is performing using the printing apparatus 1 and the graininess is bad, the image quality of an image to be printed is deteriorated even though the color difference between the bands is small.

Here, in the second embodiment, an image is printed with more excellent image quality by taking into consideration the graininess of the image in addition to the color difference between the bands.

About Graininess

As the concept of evaluating the degree of graininess, there is a granularity. In the embodiment, the graininess of an image is evaluated using an "RMS granularity".

The RMS granularity expresses the dispersion of image density using root-mean-square, and is calculated using the following Equation 2.

$$\sigma = \sqrt{\frac{\sum_{i=1}^{n} (Di - Dave)^2}{n-1}} \tag{2}$$

In Equation 2, Di indicates the density data (i-th density data) of a given position of an image, n indicates the number of density data. In addition, Dave indicates the average value of n density data.

Detection Process of Second Embodiment

In the second embodiment, a process performed until the pulse amplitude Vh is determined to form a dot having an optimal dot diameter in the detection process is different from that of the first embodiment. The configuration of the printing apparatus and various types of processes of the print process are the same as in the first embodiment.

Figure 12:
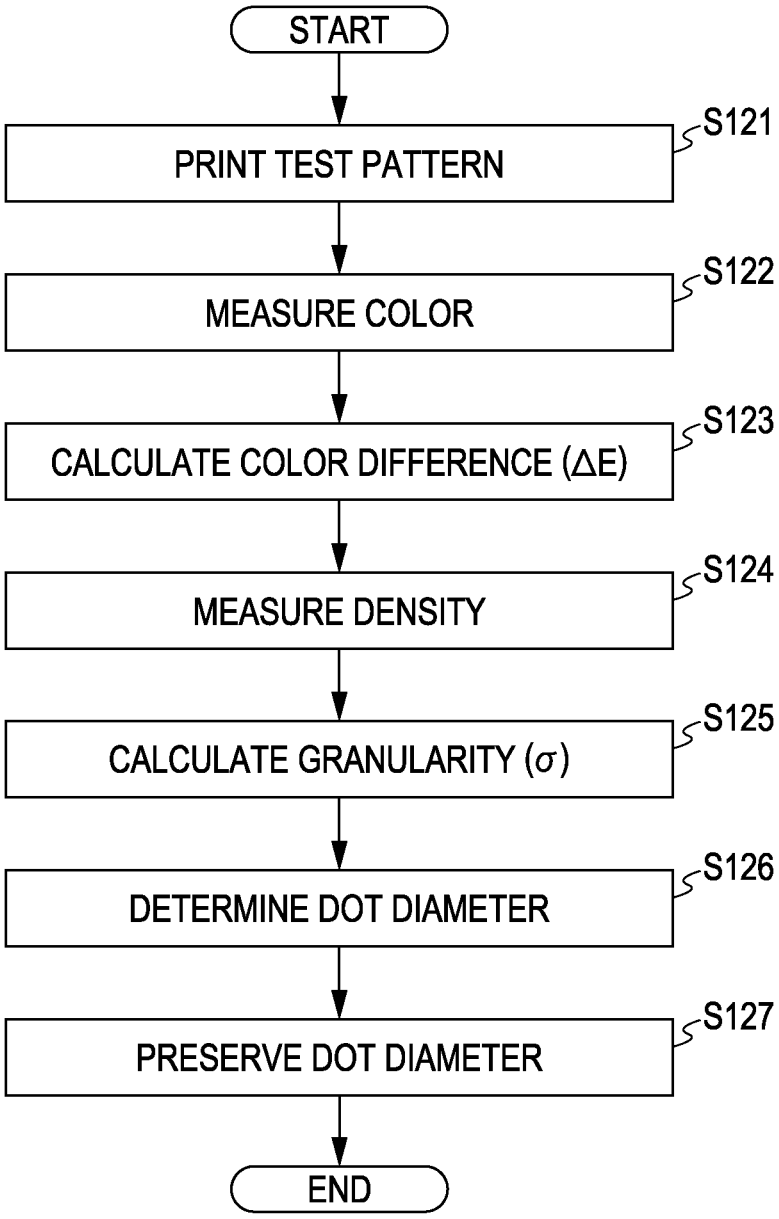
FIG. 12 is a flowchart illustrating the flow of a detection process according to a second embodiment.

FIG. 12 shows a drawing illustrating the flow of the detection process according to the second embodiment. The processes performed in steps S121 to S123 and S127 are the same as the respective corresponding processes of the first embodiment performed in steps S101 to S103 and S105, and processes performed in steps S124 to S126 are different from those of the first embodiment. Hereinafter, different points will be described.

In the detection process of the second embodiment, the test pattern is printed, the color measurement is performed, and the color difference ΔE is calculated in step S121 to S123. Thereafter, the density of each of the patches of the corresponding test pattern is measured in step S124. The test pattern which is used is the same as the test pattern described in the first embodiment (refer to FIG. 9). The density of each of the patches is measured using a microdensitometer. When the density of each patch is measured, it is conceivable that the density of the arbitrary portion of the same patch is basically uniform. However, since the density of the minute region of a micrometer order is measured in the embodiment, it is difficult to measure accurate density if dust or blur exists on a printing surface. Here, the density of a plurality of dots is measured with respect to each patch, and the average value of data included in a specific density range is determined as the density of the corresponding patch.

The measured density is preserved in the memory 63. For example, density (average density) measured from the patch A-1 is temporarily preserved in the memory 63 as $D_{A1}$. As described above, the density of each of 32 patches shown in FIG. 9 is measured.

Subsequently, the RMS granularity σ is calculated for each dot diameter (pulse amplitude Vh) using a density value measured from each of the patches in step S125. For example, the granularity $\sigma_1$ of the first patches of each of the bands A to H is calculated based on eight density values $D_{A1}$ to $D_{H1}$ which are measured from the eight patches A-1 to H-1 surrounded by the dashed line in FIG. 9. When the calculation is performed, the above-described Equation 2 is used. In the case of FIG. 9, n=8 and $D_{Aave}$ is the average value of $D_{A1}$ to $D_{H1}$ in Equation 2. This operation is performed on each dot diameter, and RMS granularity $\sigma_1$ to $\sigma_4$ are obtained with respect to the respective four types of dot diameters (the pulse amplitudes Vh1 to Vh4).

In addition, a value $\sigma_s$, which is reference used when the graininess is evaluated, is registered in the memory 63 as a threshold. When the calculated RMS granularity (for example, $\sigma_1$ to $\sigma_4$) is equal to or less than the threshold $\sigma_s$, the graininess of an image to be formed is excellent, thus it is possible to print a high-quality image. Meanwhile, when the calculated RMS granularity is greater than the threshold $\sigma_s$, the particle roughness of the image to be formed is noticeable, thus the image quality is deteriorated. As described above, it is possible to determine the graininess of the image to be printed by calculating and evaluating the size of the RMS granularity for each dot diameter. Meanwhile, the reference value $\sigma_s$ of the granularity may be changed according to the preference of the user or the purpose of the image to be printed.

Figure 13:
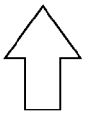
FIG. 13 is a view illustrating an example of data, in which color difference and a granularity are sorted, of the test patterns which are formed using four types of dot diameters.

In addition, the dot diameter (the pulse amplitude Vh) used when printing is actually performed is determined using both the color difference ΔE calculated in the first embodiment and the above-described granularity a in step S126, and the dot diameter is preserved in the memory 63 in step S127. When the dot diameter is determined, a dot diameter, obtained when the color difference ΔE is equal to or less than the defined value, when the color difference ΔE is the minimum value, or when the granularity σ is equal to or less than the specific reference value $\sigma_s$, is selected. FIG. 13 shows an example of data, in which the color difference ΔE and the granularity σ are sorted, with respect to the test pattern formed using four types of dot diameters a to d. In the drawing, the numerical values shown in a ΔE row are the color difference values $\Delta E_a$ to $\Delta E_d$ which are calculated for the respective dot diameters in step S123. In addition, in ○ mark or x mark shown in a σ row, ○ is expressed when the graininess is good ($\sigma \le \sigma_s$) and x is expressed when the graininess is bad ($\sigma_s < \sigma$) based on the results of comparison of the RMS granularity $\sigma_a$ to $\sigma_d$, which are calculated for the respective dot diameters, with the threshold $\sigma_s$, which is the reference, in step S125.

In FIG. 13, when attention is given to the granularity σ, the evaluation in the case of the dot diameter c is x. Therefore, the dot diameter c is excluded from the candidates of the dot diameters which are used when printing is performed, and the dot diameters a, b, and d remain as candidates. Subsequently, when attention is given to the color difference ΔE, the dot b which has a dot diameter obtained when the ΔE is the minimum value is determined as a dot diameter used when printing is performed from among the candidates. That is, an image is printed by ejecting UV ink from all the heads using the drive signal COM having the pulse amplitude Vh used to form the dots each having the dot diameter b.

When attention is given to only the color difference ΔE, the dot diameter c, obtained when the corresponding color different is the minimum value, is selected as the dot diameter used when printing is performed. However, if printing is performed using the dot diameter c, an image which has bad graininess is formed, thus it is difficult to sufficiently improve image quality. Here, as in the embodiment, an optical dot diameter is determined by taking into consideration the glossiness difference and the graininess at the same time, thus it is possible to print a high-quality image in which the color difference between the bands is small and graininess is good.

Meanwhile, in FIG. 12, each process may be executed by changing the order of the process which is performed until the color difference ΔE is calculated in steps S122 and S123 and the process which is performed until the granularity σ is calculated in step S124 and S125. For example, it is possible to first calculate the granularity σ, to execute the evaluation of the graininess, and to cause the color measurement not to be performed on patches which are formed using the rejected dot diameter as the results of the evaluation. If the process is executed as described above, a wasteful color measurement operation is not performed, thus it is possible to streamline the detection process.

In addition, as the evaluation index of the graininess according to the embodiment, another index may be used to evaluate the graininess in addition to the RMS granularity.

Summary of Second Embodiment

In the second embodiment, a dot diameter is determined by taking into consideration graininess in addition to color difference, and printing is performed using the corresponding dot diameter.

In detail, based on the results obtained by measuring the density of each of the patches of a test pattern which is the same as in the first embodiment, the RMS granularity, which is indicative of the graininess of the patches of the plurality of patches which are formed using dots having the same dot diameter for each head group, is calculated. In addition, a dot diameter, obtained when the corresponding RMS granularity is equal to or less than a specific threshold, or a dot diameter, obtained when the color difference is equal to or less than a defined value or the color difference is the minimum value, is used as the dot diameter which is used when printing is actually performed.

Therefore, it is possible to form an image in which the color difference between the bands is small and graininess is good, thus it is possible to implement printing with higher image quality.

Third Embodiment

In a third embodiment, attention is given to the glossiness difference between the bands of a printed image in addition to the above-described color difference and graininess. In detail, as the above-described each embodiment, the glossiness of the whole image is adjusted by adjusting a dot diameter and changing an ejecting amount (ink Duty) per unit area of the color ink and the clear ink.

Figure 14:
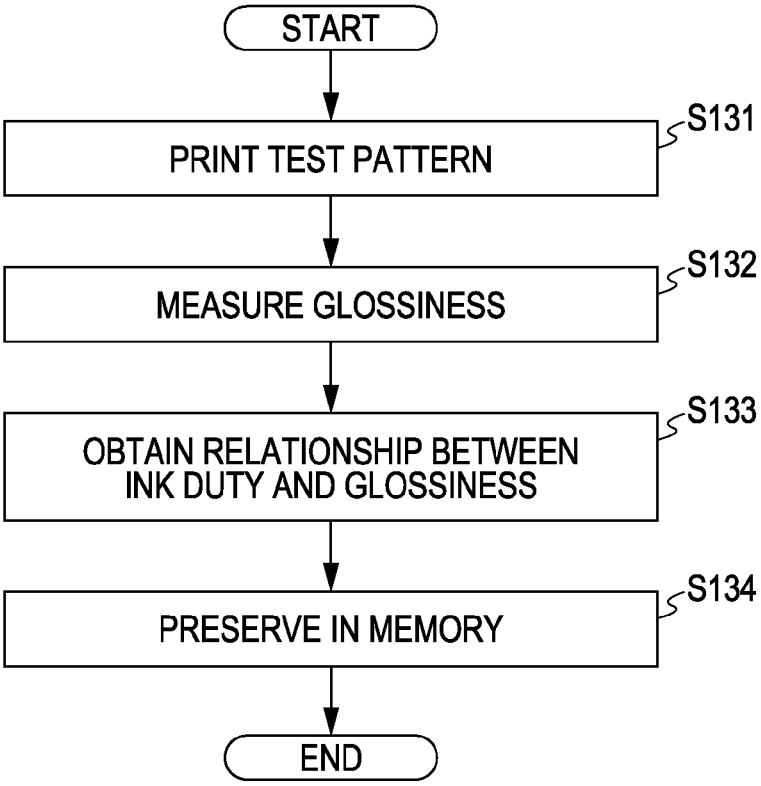
FIG. 14 is a flowchart illustrating a process of determining an ink Duty in a detection process according to a third embodiment.

The adjustment of the ink Duty is performed in such a way that a test pattern which includes a plurality of patches is printed in the detection process, and that the ejecting amount of the clear ink with respect to the ejecting amount of the color ink is adjusted based on the results obtained by measuring the glossiness of each of the patches of the corresponding test pattern. FIG. 14 shows a flow used to determine the ink Duty in the detection process of the third embodiment. The corresponding flow is independently performed of the flow used to determine the dot diameter which is described in the detection process of the first and second embodiments (see FIGS. 8 and 12).

Figure 15:
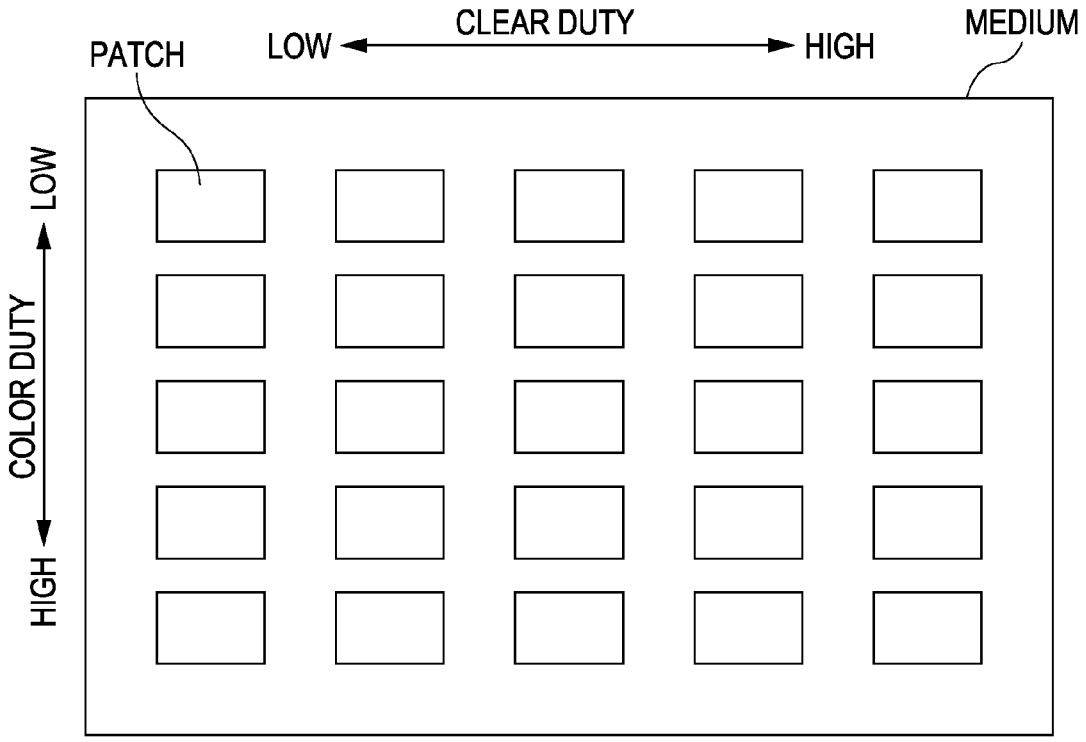
FIG. 15 is a view illustrating an example of a test pattern which is printed in a given band region according to the third embodiment.

First, the test pattern is printed in step S131. The test pattern used in the embodiment is different from the test pattern (FIG. 9) used in the first embodiment, and is separately printed. FIG. 15 shows an example of the test pattern which is printed in a given band region in the third embodiment. The test pattern is formed by printing a plurality of patches in such a way as to eject color ink and clear ink while changing Duties from the first to fourth heads (color ink heads) and a fifth head (a clear ink head) for each head group (for each band). That is, as shown in FIG. 15, the test pattern, which includes the plurality of patches formed by dividing each of the color Duty and the clear Duty into a plurality of stages, is formed for each head group (for each band). Meanwhile, in the above-described example, the test pattern is formed by ejecting four types of color ink KCMY and the clear ink at the same time. However, the test pattern may be formed for each type of color test KCMY. That is, the test pattern as shown in FIG. 15 may be formed in such a way that the test pattern is divided into the respective types of color KCMY. In this case, the ejecting amount of the clear ink with respect to the ejecting amount of the respective types of color KCMY is individually adjusted in the print process which will be described later. For example, the Duty of the clear ink CL with respect to the Duty of the black ink K is determined, and the Duty of the clear ink CL with respect to the Duty of the cyan ink C is separately determined.

The plurality of patches are formed as shown in the drawing while changing the ejecting amount of the color ink per unit area (hereinafter, referred to as color Duty) and the ejecting amount of the clear ink per unit area (hereinafter, referred to as clear Duty). Although the patches are formed while both the color ink Duty and the clear ink Duty are changed in five stages in FIG. 15, it is possible to obtain accurate data as the width of the change of the respective ink Duty is set to fine. Meanwhile, the arrangement or shapes of the respective patches are not limited to the example shown in FIG. 15.

After the test pattern is printed, the glossiness of each of the patches is measured using a gloss meter in step S132. The gloss meter is an apparatus which is capable of measuring glossiness by performing irradiation with light from a light source to a measuring surface at a specific angle (an incidence angle) and detecting light (reflected light) reflected on the measuring surface using a light receiving unit which is arranged in the mirror reflection direction. For example, gloss meter GM-60 manufactured in Konica Minolta Corporation can be used as the gloss meter. In addition, although there is a method of measuring the angle of light by 20 degrees, 45 degrees, 60 degrees, 75 degrees, or 85 degrees, measurement is performed by an incidence angle/the angle of reflection of 20 degrees in the embodiment. Since glossiness is proportional to the size of an angle, it is possible to measure the glossiness of other angles by measuring the glossiness of a light of 20 degrees without measuring the glossiness of all angles.

The value of glossiness obtained with respect to each of the patches is temporarily preserved in a storage unit, such as the memory 63 or the like. For example, the value of glossiness obtained from the patch A-1 is preserved in the memory 63 as $G_{A1}$.

Figure 16:
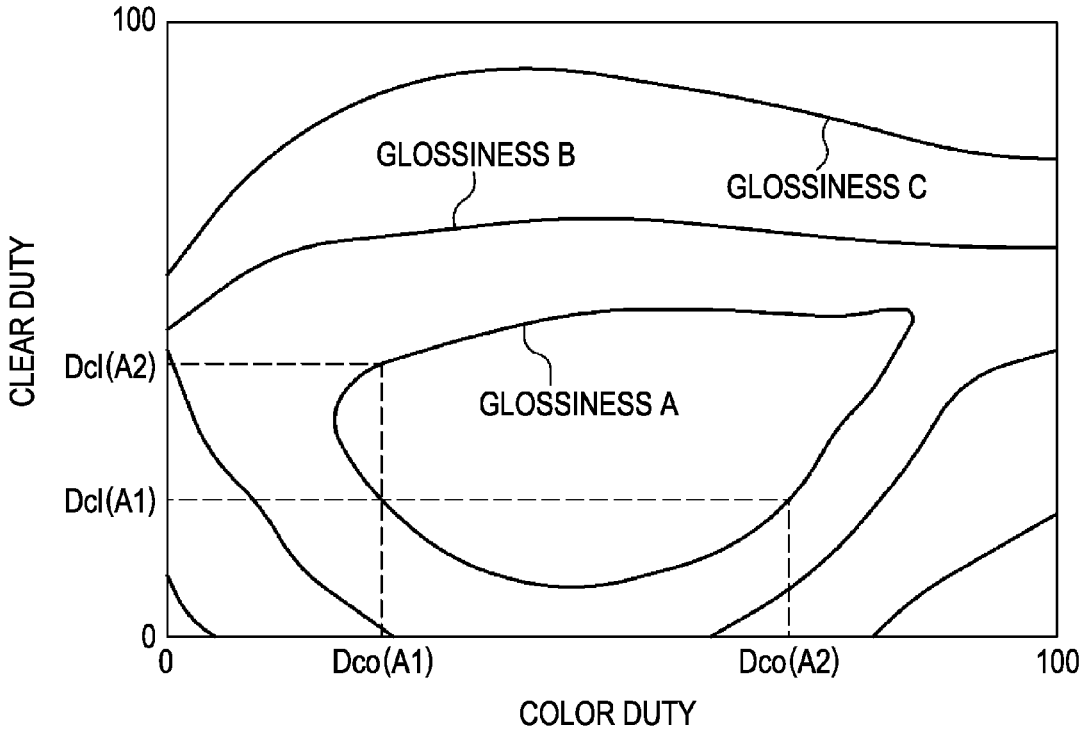
FIG. 16 is a view illustrating an example of a graph which shows the relationship between the ink Duty and the glossiness.

In addition, the relationship between the ink Duty and the glossiness is obtained based on the result of measurement performed on each of the patches in step S133. FIG. 16 shows an example of a graph which illustrates the relationship between the ink Duty and the glossiness. The graph corresponding to FIG. 16 is created for each head group (for each band). In the drawing, the longitudinal axis indicates the clear Duty, and the lateral axis indicates the color Duty. In addition, each curved line drawn as a contour line in the drawing indicates the size of the glossiness. For example, when an image is printed and the color ink is ejected such that the color Duty is Dco(A1), the clear ink may be ejected such that the clear Duty is Dcl(A1) or Dcl(A2) in order to print an image in which the size of glossiness is A. In contrast, when the clear Duty is Dcl(A1), the color Duty, which is necessary to print the image in which the size of glossiness is A, is Dco(A1) or Dco(A2). The relationship is preserved in the memory 63 in step S134.

In addition, in the print process, printing is performed while adjusting the clear Duty with respect to the color Duty based on the corresponding relationship. In detail, in the color conversion process and the halftone process shown in FIG. 11, KCMY data is created based on RGB data, and the sum of the ejecting amount of color ink KCMY per unit area is determined. Thereafter, the Duty of the clear ink is determined for each head group based on the Duty of the corresponding color ink such that specific glossiness is made, and ink is actually ejected. As described above, it is possible to print an image which has desired glossiness for each band by adjusting the clear Duty with respect to the color Duty for each head group. That is, the glossiness difference between bands is unnoticeable, thus it is possible to print a high-quality image.

Summary of Third Embodiment

In the third embodiment, an image having specific glossiness is formed for each head group (for each band) by changing the ejecting amount (clear Duty) of the clear ink per unit area according to the ejecting amount (color Duty) of the color ink per unit area in such a way that the glossiness difference between the bands is taken into consideration in addition to the color difference or the graininess difference of the printed image. That is, the glossiness of the image is adjusted by taking into consideration the clear Duty.

Since it is possible to freely control the size of the glossiness of the image, the glossiness difference between the bands is unnoticeable, thus it is possible to implement printing with higher image quality.

Fourth Embodiment

In a fourth embodiment, in order to suppress the above-described deterioration in the image quality of a printed image, an image having little glossiness difference and excellent image quality is printed throughout the whole image by compensating for glossiness difference in each band. In detail, the dot diameters of dots which are formed on the medium is changed by adjusting the size of the pulse amplitude Vh of the drive signal COM (refer to FIG. 5). If the sizes of the dots are changed, coverage factors which indicate the proportion of the dots formed in a specific region of the medium or the method of overlapping the dots are changed, thus the degree of dispersion of the reflected light on the image surface varies and the glossiness difference between the bands varies according thereto.

FIGS. 7A and 7B are views illustrating cases in which images are printed by changing the dot diameters of ink dots and which are compared with each other. FIG. 7A shows an example of a case in which printing is performed using a given specific dot diameter, and FIG. 7B shows an example of a case in which printing is performed using a dot diameter which is greater than that of FIG. 7A. In both drawings, views shown on the left show a case in which the deviation of dot landing positions does not occur, and views shown on the right show a case in which the deviation of dot landing positions occurs in the width direction by a. In addition, dots expressed using white circles in the drawing and dots expressed using oblique lines are ejected from different heads (short length heads), and the portions which are filled with black express portions in which dots are overlapped with each other.

In FIG. 7A, when the deviation of the landing positions does not occur (left view), the overlap of dots is viewed. However, when the deviation of the landing positions occurs (right view), the overlap of dots is not viewed. That is, in the example of FIG. 7A, difference easily occurs in the method of overlapping dots formed on the medium due to the deviation of the landing positions. Therefore, the proportion, in which the medium is covered using dots (coverage factors), varies. For example, compared to the right view, the coverage factors decrease as the area of the region of the black portions in the left view of FIG. 7A. Accordingly, the proportion that light which is incident on the image surface is reflected on the dot portions varies, thus the glossiness difference increases.

In contrast, in FIG. 7B, when the deviation of the landing positions does not occur (left view) and when the deviation of the landing positions occurs (right view), the overlap of dots is viewed. That is, in the example of FIG. 7B, it is difficult that difference occurs in the method of overlapping dots formed on the medium due to the deviation of the landing positions. For example, in the left view and the right view of FIG. 7B, the sums of areas of black portions of the dots are equal, thus the coverage factors of the medium are equal. Therefore, the proportions that light which is incident on the image surface is reflected on the dot portions are equivalent, thus the glossiness difference is unnoticeable even though the deviation of dot positions occurs.

As described above, even when the deviation of dot landing positions occurs, the size of the dot diameter varies, thus influence on the glossiness of the image is different. However, when printing is actually performed, the amount of ink which is ejected onto the medium per a specific region is partially different depending on a grayscale value which is instructed in the print data, thus it is difficult to say that glossiness difference decreases if integrally increasing a dot diameter.

Here, in the embodiment, the pulse amplitude Vh (the drive signal COM) is adjusted such that a dot diameter which is formed when printing is performed is an optimal size. Therefore, even when the deviation of dot landing position occurs due to the deviation of arrangement or the like, an image is printed with excellent image quality by causing the glossiness difference between bands to be unnoticeable.

Outline of Dot Diameter Adjustment

When printing is performed using the printer 1, the outline of an operation of performing printing by causing the glossiness difference which occurs between bands to be equal to or less than a given value (a defined value) or causing the glossiness difference to be minimum will be described.

In the embodiment, an image is printed while adjusting the size of a dot diameter using two processes, that is, a detection process and a print process. In the detection process, the amplitude Vh of a pulse waveform is changed using the printer 1 (that is, the dot diameter is changed), and the glossiness of a test pattern to be printed is measured, thereby calculating glossiness difference which actually occurs for each band. Thereafter, a dot diameter obtained when the calculated glossiness difference between the corresponding bands is equal to or less than the defined value or a dot diameter obtained when the calculated glossiness difference is the minimum is selected, and the waveform of the drive signal COM (the amplitude Vh of the pulse waveform) which is used to form the dot diameter is preserved in the storage medium, such as the memory 63 of the printer 1. Subsequently, in the print process, the ink dots are ejected from all the heads such that the dot diameter is the corresponding dot diameter preserved in the detection process, thus image printing is actually performed. Hereinafter, each process will be described in detail.

Detection Process

Figure 17:
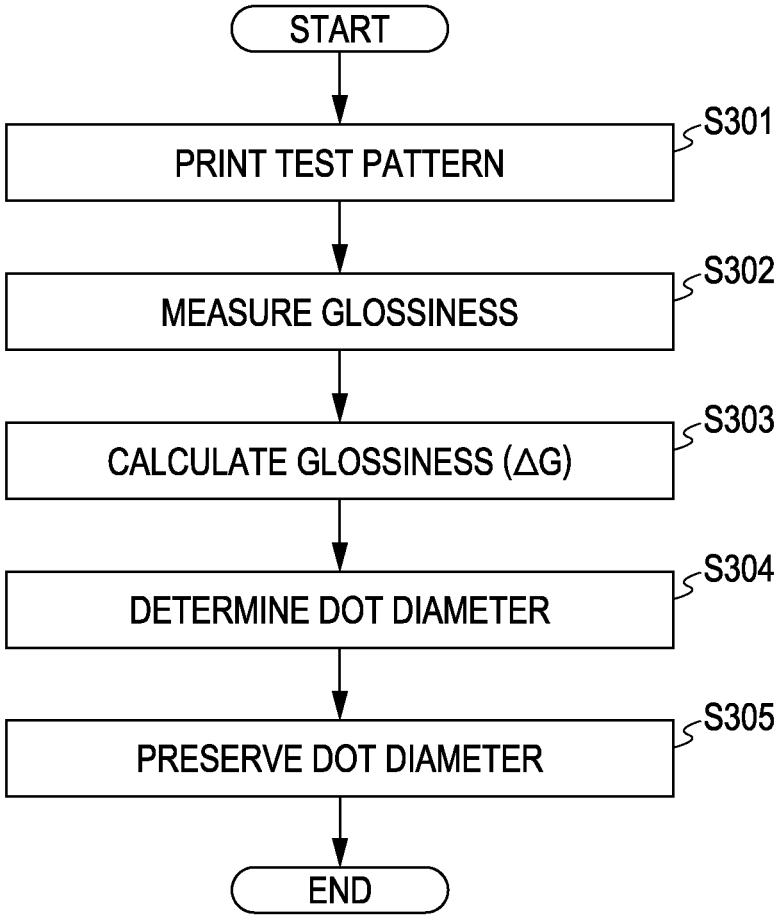
FIG. 17 is a flowchart illustrating the flow of a detection process according to a fourth embodiment.

In the detection process, glossiness is measured by printing a test pattern including a plurality of patches, and the pulse amplitude Vh which is used to define the size of the ink dot (dot diameter) to be ejected from each head is determined based on the results thereof. When printing is performed, the Vh is commonly used for all the heads of the head unit 40. FIG. 17 shows a view illustrating the flow of the detection process. The detection process is performed by executing the process of steps S301 to S305.

First, a test pattern is printed in step S301. The test pattern is formed by printing the plurality of patches using color ink KCMY in the eight bands A to H, respectively. In addition, the test pattern is printed on a medium which is the same as the medium which is actually printed.

The test pattern which is printed in the embodiment may be the same test pattern illustrated in the first embodiment (refer to FIG. 9)

Subsequently, the glossiness of each of the formed patches is measured in step S302. The glossiness of each of the patches is measured using a glossy meter. It is possible to use the glossy meter which is the same glossy meter which is used in the third embodiment.

The value of glossiness obtained with respect to each of the patches is temporarily preserved in a storage unit, such as the memory 63 or the like. For example, a glossiness value which is obtained from the patch A-1 is preserved in the memory 63 as ($G_{A1}$).

Subsequently, the glossiness difference AG between patches which are formed using the same dot diameter is calculated in step S303. As described above, since glossiness varies in an image formed using a head group in which the deviation of the arrangement occurs, there may be a case in which the patches which are formed using the same dot diameter have different glossiness values measured between bands according to a state of the head group which forms the patches. Here, the difference in the size of the glossiness between bands is calculated as glossiness difference. In the embodiment, the glossiness difference ΔG is calculated by comparing the difference between the average value of the glossiness of the plurality of patches formed using the same dot diameter with the glossiness of individual patch.

First, with respect to an n-th patch (patch m−n) included in a band m, the difference $\Delta G_{mn}$ between the average value of the glossiness of the patches (the n-th patches of the respective bands) which are formed using the same dot diameter and the glossiness of the patch m−n is obtained. $\Delta G_{mn}$ is calculated using the following Equation 3.

$$\Delta G_{mn}=\sqrt{(G_{mn}-G_{nave})^2} \quad (3)$$

In Equation 3, $G_{mn}$ indicates glossiness which is measured from the patch m−n, and $G_{nave}$ indicates the average value of the glossiness of the n-th patches of the respective bands.

In addition, the difference between the maximum value $\Delta G_{n\,(max)}$ and the minimum value $AG_{n(min)}$ of $\Delta G_{An}$ to $\Delta G_{Hn}$ which are obtained with respect to the respective n-th patches of the bands A to H is calculated as the glossiness difference $\Delta G_n$ of the n-th patch.

Figure 18:
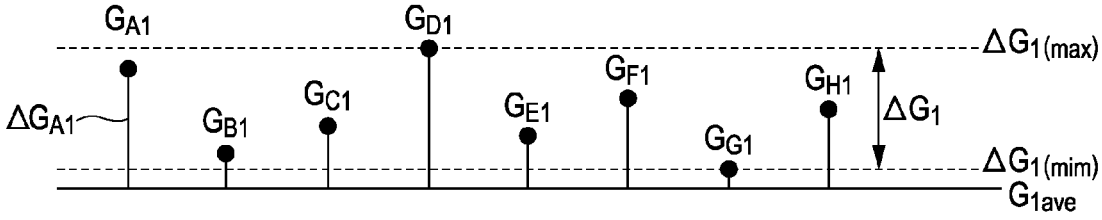
FIG. 18 is a view illustrating a method of calculating the glossiness difference of the first patch of each band in detail.

FIG. 18 shows a view illustrating a method of calculating the glossiness difference $\Delta G_1$ of the first patches of the respective bands in detail. First, eight glossiness data $G_{A1}$, $G_{B1}$, to, $G_{H1}$, which are obtained from the patches (the first patches of the respective bands) A-1, B-1, to, H-1 which are included in the region surrounded using dashed line in FIG. 9 and which are formed using the same dot diameter, are measured. $G_{A1}$, to $G_{H1}$ are data which includes variation as shown in FIG. 18. In addition, differences $\Delta G_{A1}$ to $\Delta G_{H1}$ between the respective glossiness data and the average $G_{1ave}$ of the corresponding eight data are calculated. Meanwhile, as shown in Equation 3, $\Delta G_{mn}$ is calculated as an absolute value. Subsequently, the minimum value and the maximum value of the calculated eight data $\Delta G_{A1}$ to $\Delta G_{H1}$ are obtained. In an example shown in FIG. 18, the maximum value $\Delta G_{1(max)}$ is $\Delta G_{D1}$, and the minimum value $\Delta G_{1(min)}$ is $\Delta G_{G1}$. In addition, the difference $\Delta G_{D1}-\Delta G_{G1}$ between the maximum value and the minimum value is calculated as the glossiness difference $\Delta G_1$ between the first patches of the respective bands.

Meanwhile, the glossiness difference $\Delta G_n$ may be calculated as the average value of $\Delta G_{An}$ to $\Delta G_{Hn}$. That is, $\Delta G_n$ may be calculated as $(\Delta G_{An}+\Delta G_{Bn}+$ to $+\Delta G_{Hn})/8$.

A dot diameter, obtained when the glossiness difference $\Delta G_n$ is equal to or less than a given defined value or when the corresponding glossiness difference $\Delta G_n$ is the minimum value, is selected and determined as a dot diameter which is used when printing is actually performed in step S304. The determined dot diameter is preserved in the memory 63 in step S305. For example, in the case of FIG. 9, in the eight bands A to H, the glossiness difference $\Delta G_1$ to $\Delta G_4$ of the first to fourth patches are calculated, respectively. The dot diameter (in the above-described example, the middle size dot having any one of the sizes 2.5 pl, 3.0 pl, 3.5 pl, and 4.0 pl), obtained when ΔG of the calculated four glossiness difference is equal to or less than a specific value (for example, the glossiness difference is 10) or is the minimum value, is determined as the dot diameter (the middle size dot) which is used when printing is actually performed. In other words, the pulse amplitude Vh which can be used to form an optimal dot diameter is determined.

Here, the glossiness difference is noticeable in an actual image when the glossiness difference which occurs between the adjacent bands (for example, between the bands B and C or between the bands D and E) is large. Therefore, a method of using the glossiness difference between the adjacent bands as dot diameter selection reference may be used.

In this case, with respect to the eight bands A to H, the glossiness difference between the adjacent bands are calculated, respectively, and a dot diameter, obtained when the glossiness difference between the corresponding adjacent bands is equal to or less than the defined value or when the corresponding glossiness difference is the minimum vale, is selected. In detail, seven glossiness difference, that is, the glossiness difference $|G_{A1}-G_{B1}|$ between the adjacent bands A and B, the glossiness difference $|G_{B1}-G_{C1}|$ between the bands B and C, . . . , the glossiness difference ($|G_{G1}-G_{H1}|$) between the bands G and H, are calculated. Further, a dot diameter, obtained when each of the calculated glossiness difference is equal to or less than the defined value (for example, the glossiness difference is 10) or when the average value of the glossiness difference is the minimum value, is selected as a dot diameter which is used when printing is actually performed in step S304. The selected dot diameter is preserved in the memory 63 in step S305.

In addition, an image is formed using dots each having the dot diameter, obtained when the glossiness difference ΔG between the bands is equal to or less than the defined value or is the minimum value, thus glossiness difference between the bands is not noticeable, thereby enabling the whole image to be printed with excellent image quality.

Meanwhile, each of the patches is formed using only middle size dots in the above-described example. However, when printing is actually performed, for example, when printing is performed using two-bit pixel data, an image is formed using dots having a plurality types of sizes, such as small size dots, middle size dots, large size dots, and the like. Here, when a test pattern is formed, small size dots, middle size dots, and large size dots are mixed in a single patch. That is, in the above-described process in step S301, the test pattern is formed with respect to the sets of small, middle, and large size dots which are formed in the cases of the amplitudes Vh1 to Vh4 of the drive signal COM. For example, the patch A-1 includes small size dots, middle size dots, and large size dots which are formed in the region of the band A using the pulse waveform having the amplitude Vh1, and the patch B-2 includes small size dots, middle size dots, and large size dots which are formed in the region of the band B using the pulse waveform having the amplitude Vh2.

The processes in steps S302 to S305 are performed on the test pattern, thus the size of each dot (the drive signal COM having the amplitude Vh of the pulse waveform), obtained when the glossiness difference ΔG between the bands is equal to or less than the defined value or is the minimum value, is determined when printing performed using a plurality types of dots. When printing is actually performed, small size dots, middle size dots, and large size dots are formed using the determined drive signal COM having the corresponding pulse amplitude Vh, the glossiness difference between the bands is not noticeable, thus it is possible to print the whole image with excellent image quality.

Print Process

In the print process, it is possible to use the same process as in the first embodiment.

The print data which is generated through the processing flow shown in FIG. 11 is transmitted to the printer 1 using the printer driver. In addition, printing is actually performed using the printer 1. When printing is performed, the drive signal COM having the specific pulse amplitude Vh which is preserved in the memory 63 is applied to the piezoelectric element of each of the nozzles in order to print an image by forming dots having the dot diameter obtained when the glossiness difference between the bands which are determined in the detection process is the minimum value. Therefore, the diameters of the ink dots (small, middle, and large size dots) which are ejected from all the heads (nozzles) are uniform, thus the glossiness difference between the bands is unnoticeable.

Summary of Fourth Embodiment

In the fourth embodiment, in the detection process, a test pattern, which includes a plurality of patches using dots having different dot diameters and being formed for each head group, is printed for each band, the glossiness difference of the patches in each band is obtained based on the result obtained by measuring the glossiness of the corresponding test pattern. The corresponding glossiness difference is indicative of the difference in glossiness of the patches, which are formed for each band using dots having the same dot diameter, of the plurality of patches. In addition, the dot diameter, obtained when the glossiness difference between the bands is equal to or less than the defined value or the glossiness difference is the minimum value, is selected as a dot diameter which is used to perform printing, and is preserved in the memory or the like. Thereafter, in the print process, ink is ejected from each of the head groups such that the dot diameter of the ink is the determined dot diameter.

Therefore, in the line head type printing apparatus, such as the printing apparatus 1, the glossiness difference between the bands is unnoticeable, thus it is possible to print an image with excellent image quality.

Fifth Embodiment

According to the method of the fourth embodiment, attention is given to the glossiness difference between the bands, and the glossiness difference is caused to be as small as possible by adjusting the drive signal COM such the dot diameter has a specific size, thus it is possible to improve the image quality of an image to be printed. However, if the dot diameter is determined by giving attention to only the glossiness difference between the bands, the glossiness difference can be unnoticeable but there may be a case in which the graininess of the image is deteriorated. The graininess indicates the degree of surface roughness of the whole image. For example, if ink dots (particles) which are formed on the medium are too large, individual particles are noticeable, thereby giving an impression in which the image is rough. Therefore, when printing is performing using the printing apparatus 1 and the graininess is bad, the image quality of an image to be printed is deteriorated even though the glossiness difference between the bands is small.

Here, in the fifth embodiment, an image is printed with higher image quality by taking into consideration the graininess of the image in addition to the glossiness difference between the bands.

About Graininess

The evaluation of the graininess of an image is performed using the "RMS granularity" as the same as in the second embodiment.

Detection Process of Fifth Embodiment

In the fifth embodiment, a process performed until the pulse amplitude Vh is determined in order to form a dot having an optimal dot diameter in the detection process is different from that of the fourth embodiment. The configuration of the printing apparatus and various types of processes of the print process are the same as those in the fourth embodiment.

Figure 19:
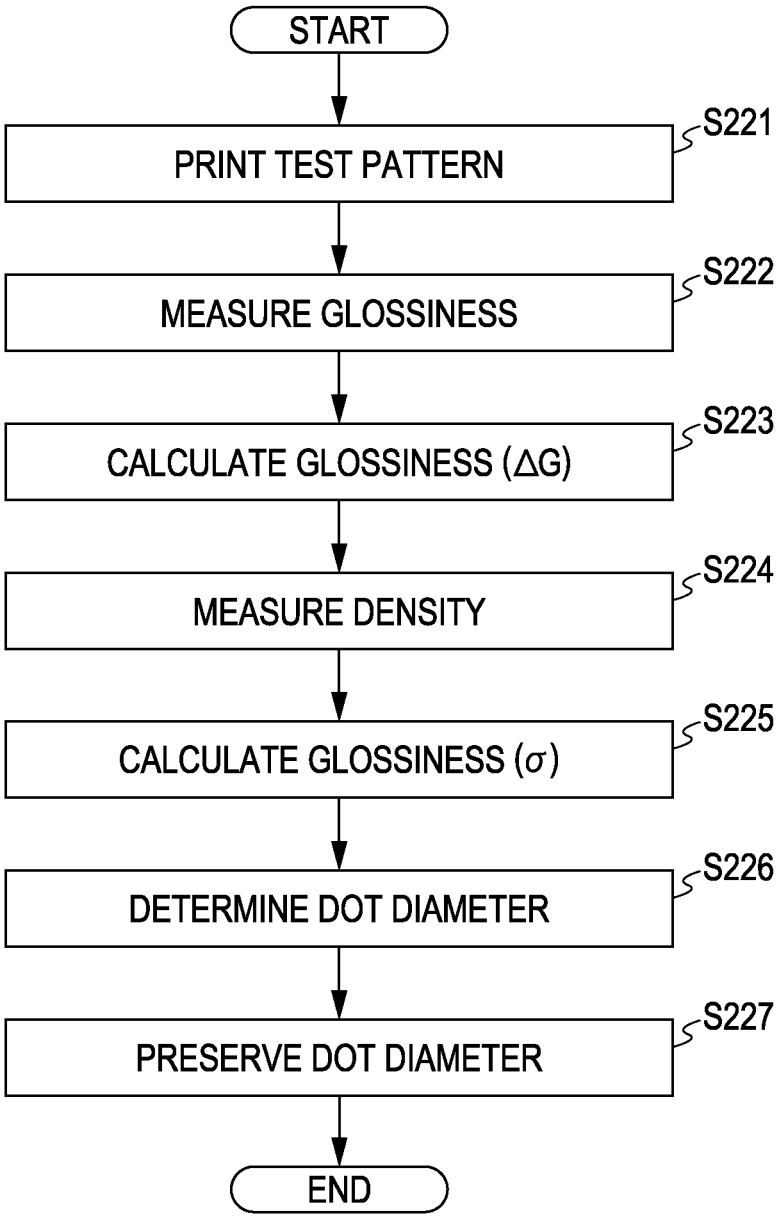
FIG. 19 is a flowchart illustrating the flow of a detection process according to a fifth embodiment.

FIG. 19 shows a drawing illustrating the flow of the detection process according to the fifth embodiment. The processes performed in steps S221 to S223 and S227 are the same as the respective corresponding processes of the fourth embodiment performed in steps S301 to S303 and S305, and processes performed in steps S224 to S226 are different from those of the fourth embodiment. Hereinafter, different points will be described.

In the detection process of the fifth embodiment, the test pattern is printed, the glossiness is measured, and the glossiness difference AG is calculated in step S221 to S223. Thereafter, the density of each of the patches of the corresponding test pattern is measured in step S224. The test pattern which is used is the same as the test pattern described in the fourth embodiment (refer to FIG. 9). The density of the patch is measured using a microdensitometer. When the density of each of the patches is measured, it is conceivable that the density of the arbitrary portion of the same patch is basically uniform. However, since the density of the minute region of a micrometer order is measured in the embodiment, it is difficult to measure accurate density if dust or blur exists on a printing surface. Here, the density of a plurality of dots is measured with respect to each patch, and the average value of data included in a specific density range is determined as the density of the corresponding patch.

The measured density is preserved in the memory 63. For example, density (average density) measured from the patch A-1 is temporarily preserved in the memory 63 as $D_{A1}$. As described above, the density of each of 32 patches shown in FIG. 9 is measured.

Subsequently, the RMS granularity σ is calculated for each dot diameter (pulse amplitude Vh) using a density value measured from each of the patches in step S225. For example, the granularity $\sigma_1$ of the first patches of each of the bands A to H is calculated based on eight density values $D_{A1}$ to $D_{H1}$ which are measured from the eight patches A-1 to H-1 surrounded by the dashed line in FIG. 9. When the calculation is performed, the above-described Equation 2 is used. In the case of FIG. 9, n=8 and $D_{Aave}$ is the average value of $D_{A1}$ to $D_{H1}$ in Equation 2. This operation is performed on each dot diameter, and RMS granularity $\sigma_1$ to $\sigma_4$ are obtained with respect to the respective four types of dot diameters (the pulse amplitudes Vh1 to Vh4).

In addition, a value $\sigma_s$, which is reference used when the graininess is evaluated, is registered in the memory 63 as a threshold. When the calculated RMS granularity (for example, $\sigma_1$ to $\sigma_4$) is equal to or less than the threshold $\sigma_s$, the graininess of an image to be formed is excellent, thus it is possible to print a high-quality image. Meanwhile, when the calculated RMS granularity is greater than the threshold $\sigma_s$, the particle roughness of the image to be formed is noticeable, thus the image quality is deteriorated. As described above, it is possible to determine the graininess of the image to be printed by calculating and evaluating the size of the RMS granularity for each dot diameter. Meanwhile, the reference value $\sigma_s$ of the granularity may be changed according to the preference of the user or the purpose of the image to be printed.

Figure 20:
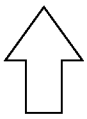
FIG. 20 is a view illustrating an example of data, in which the glossiness difference and the granularity are sorted, of the test patterns which are formed using four types of dot diameters.

In addition, the dot diameter (the pulse amplitude Vh) used when printing is actually performed is determined using both the glossiness difference ΔG calculated in the fourth embodiment and the above-described granularity σ in step S226, and the dot diameter is preserved in the memory 63 in step S227. When the dot diameter is determined, a dot diameter, obtained when the glossiness difference ΔG is equal to or less than the defined value, when the glossiness difference ΔG is the minimum value, or when the granularity σ is equal to or less than the specific reference value $\sigma_s$, is selected. FIG. 20 shows an example of data, in which glossiness difference ΔG and the granularity σ are sorted, with respect to the test pattern formed using four types of dot diameters a to d. In the drawing, the numerical values shown in a ΔG row are the glossiness difference values $\Delta G_a$ to $\Delta G_d$ which are calculated for the respective dot diameters in step S223. In addition, in ○ mark or x mark shown in a σ row, ○ is expressed when the graininess is good ($\sigma \leq \sigma_s$) and x is expressed when the graininess is bad ($\sigma_s < \sigma$) based on the results of comparison of the RMS granularity $\sigma_a$ to $\sigma_d$, which are calculated for the respective dot diameters, with the threshold $\sigma_s$, which is the reference, in step S225.

In FIG. 20, when attention is given to the granularity σ, the evaluation in the case of the dot diameter c is x. Therefore, the dot diameter c is excluded from the candidates of the dot diameters which are used when printing is performed, and the dot diameters a, b, and d remain as candidates. Subsequently, when attention is given to the glossiness difference ΔG, the dot b which has a dot diameter obtained when the value ΔG is the minimum value is determined as a dot diameter used when printing is performed from among the candidates. That is, an image is printed by ejecting UV ink from all the heads using the drive signal COM having the pulse amplitude Vh used to form the dots each having the dot diameter b.

When attention is given to only the glossiness difference ΔG, the dot diameter c, obtained when the corresponding glossiness difference is the minimum value, is selected as the dot diameter used when printing is performed. However, if printing is performed using the dot diameter c, an image which has bad graininess is formed, thus it is difficult to sufficiently improve image quality. Here, as in the embodiment, an optical dot diameter is determined by taking into consideration the glossiness difference and the graininess at the same time, thus it is possible to print a high-quality image in which the glossiness difference between the bands is small and graininess is good.

Meanwhile, in FIG. 19, each process may be executed by changing the order of the process which is performed until the glossiness difference ΔG is calculated in steps S222 and S223 and the process which is performed until the granularity σ is calculated in step S224 and S225. For example, it is possible to first calculate the granularity σ, to execute the evaluation of the graininess, and to cause the glossiness not to be measured on patches which are formed using the rejected dot diameter as the results of the evaluation. If the process is executed as described above, a wasteful measurement operation is not performed, thus it is possible to streamline the detection process.

In addition, as the evaluation index of the graininess according to the embodiment, another index may be used to evaluate the graininess in addition to the RMS granularity.

Summary of Fifth Embodiment

In the fifth embodiment, a dot diameter is determined by taking into consideration graininess in addition to the glossiness difference, and printing is performed using the corresponding dot diameter.

In detail, based on the results obtained by measuring the density of each of the patches of the test pattern which is the same as in the fourth embodiment, the RMS granularity, which is indicative of the graininess of the patches of the plurality of patches which are formed using dots having the same dot diameter for each head group, is calculated. In addition, a dot diameter, obtained when the corresponding RMS granularity is equal to or less than a specific threshold, or a dot diameter, obtained when the glossiness difference is equal to or less than a defined value or the glossiness difference is the minimum value, is used as the dot diameter which is used when printing is actually performed.

Therefore, it is possible to form an image in which the glossiness difference between the bands is small and graininess is good, thus it is possible to implement printing with higher image quality.

Sixth Embodiment

In a sixth embodiment, the glossiness of an image is adjusted by additionally changing the ejecting amount (the ink Duty) of the color ink and the clear ink per unit area after adjusting the dot diameter as in each of the above-described embodiments.

The adjustment of the ink Duty is performed in such a way that a test pattern which includes a plurality of patch is printed in the detection process, and the ejecting amount of clear ink with respect to the ejecting amount of color ink is adjusted based on the result of measurement performed on the glossiness of each of the patches of the corresponding test pattern. The flow of determining the ink Duty in the detection process of the sixth embodiment may use the same flow of determining the ink Duty in the detection process of the third embodiment (FIG. 14), and is executed independently of the flow of determining the dot diameter described in the detection process of the fourth and the fifth embodiments (FIGS. 17 and 19).

In addition, the relationship between the ink Duty and the glossiness is obtained based on the result of measurement of each of the patches, and printing is performed while adjusting the clear Duty with respect to the color Duty based on the corresponding relationship.

As described above, it is possible to print an image having desired glossiness for each band by adjusting the clear Duty with respect to the color Duty for each head group. That is, the glossiness difference between the bands is unnoticeable, thus it is possible to print a high-quality image.

Summary of Sixth Embodiment

In the sixth embodiment, an image having specific glossiness for each head group (for each band) is formed by changing the ejecting amount (clear Duty) per unit area of the clear ink based on the ejecting amount (color Duty) per unit area of the color ink. That is, the glossiness of an image is adjusted by adjusting the clear Duty.

Since it is possible to freely control the size of the glossiness of an image, the glossiness difference between the bands is unnoticeable, thus it is possible to implement printing with higher image quality.

Other Embodiments

Although a printer or the like has been described as the embodiments, the above-described embodiments are to make the present invention easier to understand, and do not limit and interpret the invention. The present invention may be modified and improved without departing from the gist thereof, and the equivalents may be included in the invention. In particular, embodiments which are described below may be included in the invention.

About Printing Apparatus

In each of the above-described embodiments, a printer is described as an example of the print apparatus. However, the present invention is not limited thereto. For example, the same technology as the embodiment may be applied to various types of printing apparatuses, such as a color filter manufacturing apparatus, a dyeing apparatus, a microfabricated apparatus, a semiconductor manufacturing apparatus, a surface processing apparatus, a 3-dimensional modeling apparatus, a liquid vaporization apparatus, an organic EL manufacturing apparatus (in particular, high polymer EL manufacturing apparatus), a display manufacturing apparatus, a deposition apparatus, a DNA chip manufacturing apparatus, or the like, to which an inkjet technology is applied.

About Nozzle Arrays

In the above-described embodiments, an example in which an image is formed using the four types of color KCMY and the clear ink. However, the present invention is not limited thereto. For example, an image may be recorded using color ink, such as light cyan, light magenta, white, or the like, in addition to KCMY and CL.

In addition, the arrangement order of the nozzle arrays of the head unit is arbitrary. For example, the order of the nozzle arrays K and C may be changed, and the number of nozzle arrays of the ink K may be greater than the number of nozzle arrays of other types of ink.

About Piezoelectric Element

In each of the above-described embodiments, the piezoelectric element PZT is illustrated as an element which performs an operation of ejecting liquid. However, other elements may be used. For example, a heater element or an electrostatic actuator may be used.

About Ink to be Used

In each of the above-described embodiments, an example is described in which ink (for example, UV ink) which is cured after being irradiated with light such as UV or the like is used as liquid (ink) used for printing. However, ink used for printing is not limited to such UV ink. For example, the present invention may be applied to a printing apparatus which uses other types of ink, such as general water-based ink which is fixed to the medium by permeating therethrough, solvent-based ink which is fixed to the medium in such a way that solvent evaporates, and the like.

The entire disclosure of Japanese Patent Application No.: 2011-230994, filed Oct. 20, 2011 and 2011-230993, filed Oct. 20, 2011 are expressly incorporated by reference herein.

What is claimed is:

1. A printing apparatus comprising:

a head unit that includes a plurality of head groups in a direction which crosses a transport direction, each of the head groups having a first head which ejects first ink to a medium transported in the transport direction, and a second head which is arranged in the transport direction together with the first head and which ejects second ink onto the medium, wherein an image is printed by forming dots using the first ink and dots using the second ink in bands, which are regions to which the ink is ejected, for each head group, wherein color difference, which indicates difference in color between patches formed for each band using dots each having same dot diameter from among a plurality of patches, is obtained based on a result of color measurement performed on a test pattern which includes the plurality of patches for each band, each of the plurality of patches being formed for each head group using dots having different dot diameters, and wherein an amount of the first ink and an amount of the second ink, which are respectively ejected from the first head and the second head which are included in all the head groups, are adjusted such that the dot diameter is determined based on the color difference.

2. The printing apparatus according to claim 1, wherein the color difference between the adjacent bands is calculated based on a value obtained by performing the color measurement on each of the plurality of patches which are formed for each head group using dots having the same dot diameter, wherein the dot diameter is selected such that the calculated color difference is equal to or less than a defined value or is a minimum value, and wherein the amount of the first ink and the amount of the second ink, which are respectively ejected from the first head and the second head which are included in all the head groups, are adjusted such that the dot diameter is the selected dot diameter.

3. The printing apparatus according to claim 1, wherein, with respect to values respectively obtained by performing the color measurement on the plurality of patches which are formed for each head group using dots having the same dot diameter, the color difference is calculated based on difference between an average value of the values obtained by performing the color measurement and each of the values obtained by performing the color measurement, wherein the dot diameter is selected such that the calculated color difference is equal to or less than a defined value or is a minimum value, and wherein the amount of the first ink and the amount of the second ink, which are respectively ejected from the first head and the second head which are included in all the head groups, are adjusted such that the dot diameter is the selected dot diameter.

4. The printing apparatus according to claim 1, wherein, based on a result obtained by measuring a density of each of the patches of the test pattern, granularity, which indicates graininess of the patches which are formed for each head group using dots having the same dot diameter from among the plurality of patches, is obtained, and wherein the amount of the first ink and the amount of the second ink, which are respectively ejected from the first head and the second head which are included in all the head groups, are adjusted using the dot diameter obtained when the granularity is equal to or less than a specific threshold.

5. The printing apparatus according to claim 1, further comprising:

a third head that is arranged in the transport direction together with the first head, and that ejects third ink onto the medium, wherein, when the first ink is glossiness ink and the third ink is clear ink, an ejecting amount of third ink per unit area is changed based on the ejecting amount of first ink per unit area.

6. The printing apparatus according to claim 1, further comprising:

a radiation unit that performs irradiation with light, wherein the ink is cured when the ink is irradiated with the light.

7. A printing method causing a head unit, which includes a plurality of head groups in a direction which crosses a transport direction, each of the head groups having a first head which ejects first ink to a medium transported in the transport direction, and a second head which is arranged in the transport direction together with the first head and which ejects second ink onto the medium, to print an image by forming dots using the first ink and dots using the second ink in bands, which are regions to which the ink is ejected, for each head group, wherein color difference, which indicates difference in color between patches formed for each band using dots each having same dot diameter from among a plurality of patches, is obtained based on a result of color measurement performed on a test pattern which includes the plurality of patches for each band, each of the plurality of patches being formed for each head group using dots having different dot diameters, and wherein an amount of the first ink and an amount of the second ink, which are respectively ejected from the first head and the second head which are included in all the head groups, are adjusted such that the dot diameter is determined based on the color difference.

8. A printing apparatus comprising:

a head unit that includes a plurality of head groups in a direction which crosses a transport direction, each of the head groups having a first head which ejects first ink to a medium transported in the transport direction, and a second head which is arranged in the transport direction together with the first head and which ejects second ink onto the medium, wherein an image is printed by forming dots using the first ink and dots using the second ink in bands, which are regions to which the ink is ejected, for each head group, wherein glossiness difference, which indicates difference in glossiness between patches formed for each band using dots each having same dot diameter from among a plurality of patches, is obtained based on a result of glossiness measurement performed on a test pattern which includes the plurality of patches for each band, each of the plurality of patches being formed for each head group using dots having different dot diameters, and wherein an amount of the first ink and an amount of the second ink, which are respectively ejected from the first head and the second head which are included in all the head groups, are adjusted such that the dot diameter is determined based on the glossiness difference.

9. The printing apparatus according to claim 8, wherein the glossiness difference is calculated based on difference in glossiness between the adjacent bands with respect to the glossiness which is measured from each of the plurality of patches which are formed for each head group using dots having the same dot diameter, wherein the dot diameter is selected such that the calculated glossiness difference is equal to or less than a defined value or is a minimum value, and wherein the amount of the first ink and the amount of the second ink, which are respectively ejected from the first head and the second head which are included in all the head groups, are adjusted such that the dot diameter is the selected dot diameter.

10. The printing apparatus according to claim 8, wherein, with respect to glossiness measured from each of the plurality of patches which are formed for each head group using dots having the same dot diameter, the glossiness difference is calculated based on difference between an average value of the glossiness and each glossiness, wherein the dot diameter is selected such that the calculated glossiness difference is equal to or less than a defined value or is a minimum value, and wherein the amount of the first ink and the amount of the second ink, which are respectively ejected from the first head and the second head which are included in all the head groups, are adjusted such that the dot diameter is the selected dot diameter.

11. The printing apparatus according to claim 8, wherein, based on a result obtained by measuring a density of each of the patches of the test pattern, granularity, which indicates graininess of the patches which are formed for each head group using dots having the same dot diameter from among the plurality of patches, is obtained, and wherein the amount of the first ink and the amount of the second ink, which are respectively ejected from the first head and the second head which are included in all the head groups, are adjusted using the dot diameter obtained when the granularity is equal to or less than a specific threshold.

12. The printing apparatus according to claim 8, further comprising:

a third head that is arranged in the transport direction together with the first head, and that ejects third ink onto the medium, wherein, when the first ink is color ink and the third ink is clear ink, an ejecting amount of third ink per unit area is changed based on the ejecting amount of first ink per unit area.

13. The printing apparatus according to claim 8, further comprising:

a radiation unit that performs irradiation with light, wherein the ink is cured when the ink is irradiated with the light.

* * * * *